US006298689B1

(12) United States Patent
Lai

(10) Patent No.: US 6,298,689 B1
(45) Date of Patent: Oct. 9, 2001

(54) JEWELRY SETTING

(75) Inventor: Danny S. Lai, New York, NY (US)

(73) Assignee: Gramercy Jewelry Manufacturing Corp., New York, NY (US)

( * ) Notice: Subject to any disclaimer, the term of this patent is extended or adjusted under 35 U.S.C. 154(b) by 0 days.

(21) Appl. No.: 09/642,336

(22) Filed: Aug. 21, 2000

(51) Int. Cl.[7] ..... A44C 17/02

(52) U.S. Cl. ..... 63/26; 63/27; 63/28; D11/91; D11/92

(58) Field of Search ..... 63/26, 27, 28, 63/29.1; D11/89, 90, 91, 92

(56) References Cited

U.S. PATENT DOCUMENTS

| | | | | |
|---|---|---|---|---|
| D. 22,797 | * | 9/1893 | Powers et al. | D11/90 |
| D. 80,898 | * | 4/1930 | Kaufman | D11/92 |
| D. 143,988 | * | 2/1946 | Pennino | D11/86 |
| D. 403,611 | | 1/1999 | Lai . | |
| D. 411,134 | | 6/1999 | Lai . | |
| D. 425,817 | | 5/2000 | Gurevich et al. . | |
| D. 427,934 | | 6/2000 | Lai . | |
| D. 432,448 | * | 10/2000 | Lai | D11/92 |
| 1,351,205 | * | 8/1920 | Eliasoff et al. | 63/28 |
| 1,818,324 | * | 8/1931 | Hamin | 63/28 |
| 1,941,684 | * | 1/1934 | Hiller | 63/28 |
| 2,056,705 | * | 10/1936 | Arpels | 63/28 |
| 2,207,869 | * | 7/1940 | Monnier | 63/32 |
| 2,907,187 | | 10/1959 | Karp et al. . | |
| 4,878,364 | * | 11/1989 | Freilich | 63/28 |
| 5,123,265 | | 6/1992 | Ramot . | |
| 5,377,506 | | 1/1995 | Tranzer . | |
| 5,423,196 | * | 6/1995 | Pollack | 63/28 |
| 5,520,017 | | 5/1996 | Vivat . | |
| 5,524,458 | * | 6/1996 | Buchner | 63/28 |
| 5,649,434 | * | 7/1997 | Itzkowitz | 63/26 |
| 5,848,539 | | 12/1998 | Ouzounian . | |
| 6,003,335 | | 12/1999 | Gurevich et al. . | |
| 6,012,302 | * | 1/2000 | Hurwitz et al. | 63/26 |
| 6,026,660 | | 2/2000 | Lai . | |

* cited by examiner

*Primary Examiner*—B. Dayoan
*Assistant Examiner*—Andrea Chop
(74) *Attorney, Agent, or Firm*—Baker Botts L.L.P.

(57) ABSTRACT

A multi-stone setting for gemstones which includes at least one prong, a first arrangement and at least one second arrangement. The first arrangement includes at least one first holding member, which is coupled to the prong, and which extends in a first plane. The second arrangement includes at least one second holding member, and coupled to the prong and to the first arrangement. The second arrangement extends in at least one second plane. The second plane is provided at an angle which is between 0° and 90° with respect to the first plane. The second holding member forms at least two gemstone seats

21 Claims, 32 Drawing Sheets

JEWELRY SETTING

FIELD OF THE INVENTION

The present invention relates to a jewelry setting for maintaining thereon center gemstones and side gemstones. The center and side stones simulate an appearance either on each of a side portion and a top portion of the setting or as a combination thereof of a single larger stone. Moreover, the gemstones are mounted so as to render the internal portions of the jewelry setting substantially invisible.

BACKGROUND INFORMATION

Invisible gemstone settings are well known in the art. In particular, an invisible gemstone setting is one in which the setting lies below the visible surface of the gemstone. One commonly used approach has been to place gemstones with notched sidewalls in parallel walled channels. Metallic projections from the channel walls engage the notches and maintain the gemstones in place thereby, rendering only the top surface of the gemstones visible. In another known jewelry setting arrangement, either four or six (rectangular or square) gemstones with notched sidewalls are mounted between corner prongs with the aid of supporting cross members that engage the notches in the sidewalls. The top surfaces of the smaller gemstones provide an appearance of a top surface of a single larger gemstone.

Conventional invisible multi-stone jewelry setting arrangements suffer from several disadvantages. One of such disadvantages is that these settings are substantially two dimensional. Multiple gemstones in such setting arrangements can only simulate the appearance of the top surface of a single larger gemstone.

Known invisible settings for multiple gemstones have been disclosed in, for example, U.S. Pat. No. 6,003,335 and U.S. Pat. No. D425,817, both to Gurevitch et al. Both of these documents describe a setting in which either four or six square-shaped or rectangular-shaped gemstones are mounted on a setting to simulate the appearance of one larger, square-shaped or rectangular-shaped gemstone. The settings shown and described in these publications constrain the top surfaces of the smaller gemstones so as to lie in the same plane. Such known settings, however, do not allow the top surfaces of a number of smaller gemstones to simulate the top facet and side facets of, e.g., a single, larger gemstone. Accordingly these prior documents do not disclose the structure and configuration of the jewelry setting according to the present invention.

U.S. Pat. No. 5,848,539 describes an invisible, multi-stone, setting for two or more rows of round stones. This publication describes a setting having interior sidewalls that extend in a zig-zag manner, and in which all of the stones abut and extend essentially in the same plane. This prior art arrangement does not disclose that the smaller round gemstones can be facilitated on the setting to substantially simulate the appearance of a single larger gemstone, with a smaller gemstones capable of being provided on a top portion and on a side portion of the setting thereof.

U.S. Pat. No. 5,520,017 describes an invisible multi-stone setting for two or more rows of square-shaped or rectangular-shaped gemstones that are disposed in a series of parallel grooves. This conventional jewelry setting renders only the top surface of the stones visible. Indeed, the top surfaces of every stone are mounted in the same plane, or are constrained to lie on a surface with a large radius of curvature.

U.S. Pat. No. 5,377,506 describes a gem setting for a coherent array of overlapping round gems. The gems are set over a larger areas into large top bodies. A plurality of small stones, having a round top-view configuration, are disposed in the top of a methal jewelry piece body snugly side by side. Pointed ends of the gems are each inserted into corresponding open bottom funnel-shaped setting recesses milled into the solid metal of the piece body. After the insertion, the gems are held by the prongs which have been formed intermediately of the funnel-shaped setting recesses.

U.S. Pat. No. 5,123,265 describes an invisible gemstone setting for a large number of rectangular-shaped or square-shaped gemstones which have grooves in the sidewalls thereof. The setting includes a base with a plurality of ribs defining at least one socket having a rectangular configuration. The gemstones have a same configuration to fit into the socket. The ribs of the setting are bent at their outer ends into the grooves to fix the gemstones in the sockets.

U.S. Pat. Nos. Des. 403,611,411,134, and 427,934, which are assigned to the assignee of the present invention, disclose an ornamental design of a jewelry setting in which, e.g., square or rectangular cut gemstones are mounted between four corner prongs. The top surfaces of the four gemstones may lie substantially in the same plane.

U.S. Pat. No. 2,907,187 discloses a setting for a group of precious stones, such as diamonds, which allegedly provides an appearance of a single large stone. The setting includes a gem mounting which has four mutually upwardly and outwardly upright members. The upright members are joined to one another by four pairs of spaced parallel bars. The tops of each set are flat and define a plane which is inclined downwardly and outwardly with respect to the horizontal at an acute angle. Rod-shaped stones are initially seated on the setting so that they rest loosely on the pairs of the bars of the mounting. When so seated, the edges of a central stone directly abut an edge of each of the stones so that when viewed from the top, the assembly has the appearance of a single stone of a larger size.

None of the above-described conventional gemstone settings provide the jewelry setting arrangement of the present invention which allows a number of smaller gemstones to be situated thereon for substantially simulating the appearance of a single larger gemstone. In addition, none of the prior art publications disclose the jewelry arrangement which, when facilitating smaller gemstones on each of its side and top portions, an appearance of a single larger gemstone being provided in each of the top and side portions thereof is simulated.

OBJECTS AND ADVANTAGES OF THE PRESENT INVENTION

The present invention overcomes the above-described disadvantages of the conventional jewelry settings in a number of ways, e.g., their high cost of production, poor scalability, and simulation of the appearance of only the top portion of a single large gemstone. The present invention also provides an economical and versatile invisible setting for accommodating a number of gemstones. Various different number, e.g., embodiments of the jewelry setting of the present invention allow twelve, sixteen, twenty-one etc. of gemstones to be placed thereon. Thus, e.g., a number of smaller gemstones can be mounted so that their top surfaces simulate the appearance of the top and side facets of a single larger gemstone (e.g., a princess cut diamond). Such simulation of the single larger gemstone provides an appearance which is considerably larger than the separate appearance of the smaller component gemstones if provided in a conventional jewelry setting. The configuration of the jewelry setting according to the present invention provides the consumer with a three-dimensional appearance of the overall combination of the gemstones and the jewelry setting.

Accordingly, it is an object of the present invention to provide a jewelry setting adapted for holding therein a number of rectangular-shaped or square-shaped gemstones to provide an appearance of the top facet and the side facets of a single larger gemstone.

Another object of the present is to provide a set of gemstones on each of a top portion and at least one side portion of jewelry setting to simulate an appearance of a single larger gemstone on each of the top and side portions of the jewelry setting.

Another object of the present invention is to provide a jewelry setting adapted for holding a number of gemstones in which the appearance of a single larger gemstone (which is larger than the combined total carat weight of the constituent gemstones) is simulated.

Another object of the present invention is to provide a Jewelry setting adapted for holding the gemstones as described above for the use in jewelry items such as rings, pins, brooches, pendants, clasps, necklaces, bracelets, anklets, earrings and the like.

SUMMARY OF THE INVENTION

In accordance with the present invention, a jewelry setting adapted for holding gemstones therein is provided. The side walls of at least some of the gemstones include notches. The setting includes a first arrangement, in which a number of gemstones can be mounted with their top surfaces extending in a first plane. These gemstones are maintained in the setting using holding members that may engage the notches in the sidewalls of the gemstones. The jewelry setting also includes a second arrangement, in which a number of gemstones can be mounted, with their top surfaces extending in a second plane. The gemstones that are maintained in the second arrangement can also be maintained in the jewelry setting using the holding members. The first and second arrangements extend along different planes, and facilitate the gemstones provided therein to simulate an appearance of the top and side facets of a single larger gemstone, respectively, or an appearance of a single larger gemstone mounted in the first arrangement, and another larger gemstone provided in the second arrangement.

In another embodiment of the jewelry setting, the first arrangement is adapted for holding four rectangular-shaped gemstones therein. In addition, four second arrangements can also be provided, each capable of facilitating two rectangular-shaped gemstones therein. The jewelry setting may also include four corner prongs.

Another embodiment of the jewelry setting provides that the first arrangement is adapted for facilitating six rectangular-shaped gemstones therein, and each of two second arrangements is adapted for holding two rectangular-shaped gemstones. In addition, this embodiment provides that each of two further second arrangements is capable of facilitating three rectangular-shaped gemstones therein.

Yet another embodiment of the jewelry setting provides that the first arrangement is capable of facilitating nine rectangular-shaped gemstones therein, each of four second arrangements is capable of facilitating three rectangular-shaped gemstones.

Further embodiments of the jewelry setting provide that the corner prongs (or posts) have round-shaped, square-shaped, rectangular-shaped and/or L- or V-shaped cross sections.

BRIEF DESCRIPTION OF THE DRAWINGS

Further objects, features, and advantages of the present invention will become apparent upon consideration of the following detailed description of the presently preferred embodiments when taken in conjunction with the accompanying drawings, wherein.

DETAILED DESCRIPTION

Figure 1A:
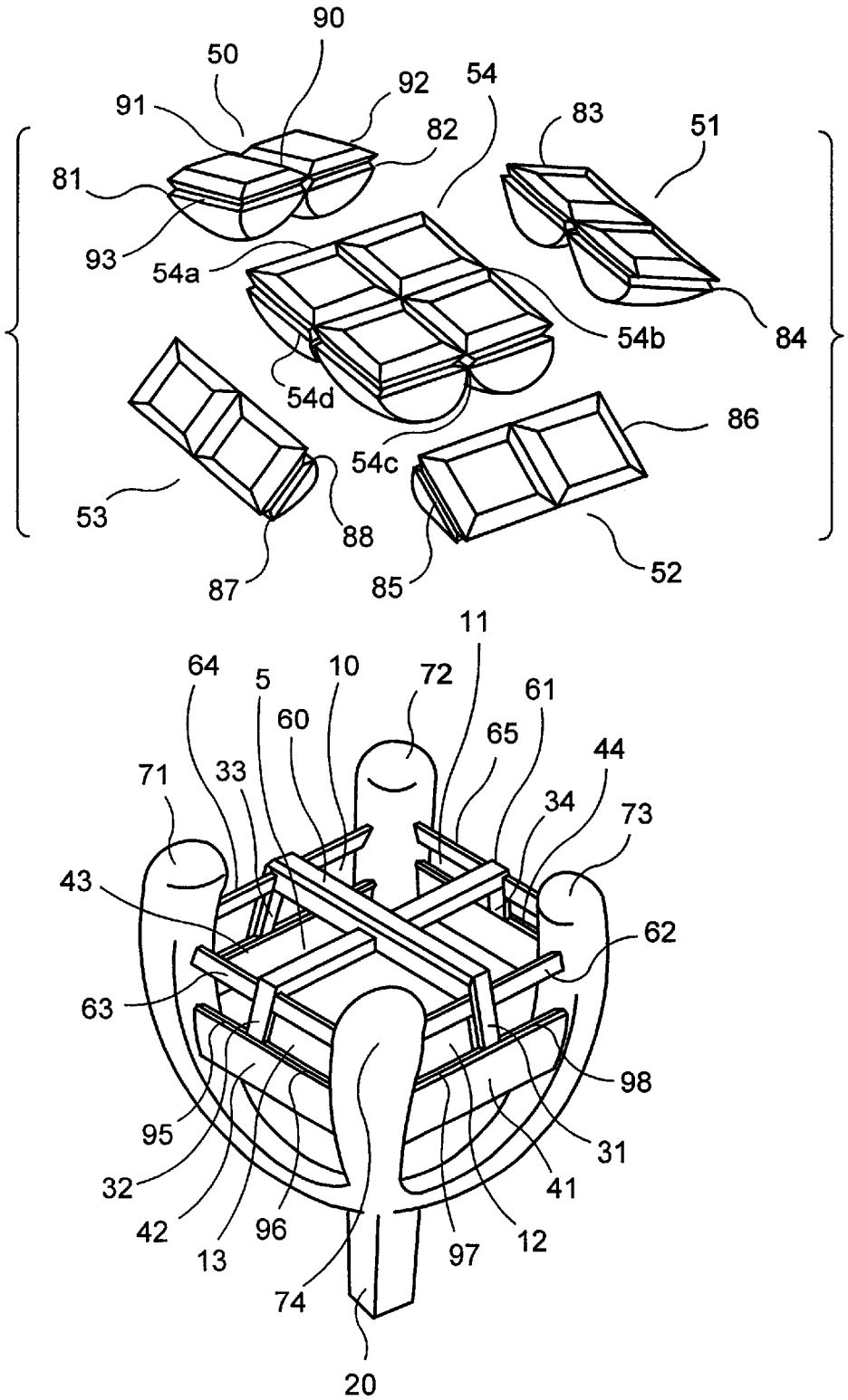
FIG. 1A shows a perspective view of a first variation of a first embodiment of the jewelry setting for providing four gemstones an a top portion and two gemstones on each side portion.

A first exemplary embodiment of the jewelry setting according to the present invention is shown in FIGS. 1A–2B, 3 and 4. In particular, FIG. 1A shows a perspective view of a first variation of a first embodiment according to the present invention with round shaped corner prongs, which allows four gemstones to be facilitated in its top portion, and two gemstones to be facilitated in each of its side portions. A first rectangular frame includes four side members 62–65, which is attached at its corners to four round corner prongs 71–74. A first crossbar (e.g., holding member) 60 extends from approximately the middle of the side member 64 to approximately the middle of a side member 62. A second crossbar (e.g., holding member) 61, extends from the middle of the side member 63 to approximately the middle of the side member 65. The first crossbar 60 extends along a first plane, and the second crossbar 61 extends along a second plane. The first plane is substantially parallel to and above the second plane. It is also conceivable (as shown in FIG. 2A) that the first plane and the second plane are the same, i.e., the first crossbar 60 and the second cross bars 61 extend along the same plane. The first crossbar 60 extends in a direction which is substantially perpendicular to the extension direction of the second crossbar 61. The jewelry setting shown in FIG. 1A is capable of facilitating thereon twelve gemstones, each having four sidewalls, preferably at least one of the sidewalls being notched (or having grooves therein). The notches in the side walls of the four center gemstones 54 engage with the first and second crossbars 60, 61 (or with the tracks provided thereon) and with the side members 62–65 of the first rectangular frame 5. The four gemstones 54 also abut the four corner prongs 71–75 which retain the four gemstones 54. Such configuration of square-shaped center gemstones in a jewelry setting is described in detail in U.S. Pat. No. 6,003,335, the entire disclosure of which is incorporated herein by reference.

In the first variation of the first embodiment of the jewelry setting according to the present invention shown in FIG. 1A, four second rectangular frames 10–13 are connected to four respective side members 41–44. In particular, the first 10 of the second frames 10–13 is connected between the first and second corner prongs 71, 72, the second 11 of the second frames 10–13 is connected between the second and third corner prongs 72, 73; the third 12 of the second frames 10–13 is connected between the third and fourth corner prongs 73, 74; and the fourth 13 of the second frames 10–13 is connected between the fourth and first corner prongs 74, 71.

A cross member 31 (e.g., holding member) extends from substantially the middle of the side member 41 to substantially the middle of the side member 62. In a similar manner, the cross member (e.g., holding member) 32 of the fourth 13 of the second frames 10–13 extends from substantially the middle of the side member 42 to substantially the middle of the side member 63. The cross member (e.g., holding member) 33 of the first 10 of the second frames 10–13 extends from substantially the middle of the side member 43 to substantially the middle of the side member 64, and the cross member (e.g., holding member) 34 of the second 12 of the second frames 10–13 extends from substantially the middle of the side member 44 to substantially the middle of the side member 65. The second frames 10–13 extend along different planes, each at angles which may be acute (e.g., between 0° and 90°, and possibly inclusive of 0° and 90°) with respect to the first and second planes formed by the first frame 5. Indeed, each of the cross members 31, 32, 33, 34 extends at an axis which is provided at angle (with respect to an axis along which the first crossbar 60 extends) that is the same as the angle at which the respective one of the second portions 10–13 extends.

Four sets of gemstones 50–53, with each set including a pair of gemstones, are facilitated so as to abut or be near outer sidewalls 54*a*–54*d* of a further set of the gemstones (i.e., the center gemstones 54) which has four gemstones when the further set 54 of gemstones is seated in the first frame 5. In the case of a first set 50 of the gemstones, the notches 81 and 82 thereof engage with the upper surface of the side member 43 and with a lower surface of the side member 64, respectively. The mutually contacting side walls 90, 91 engage the cross member 33 via their respective inner notches (not shown in FIG. 1A for the sake of clarity) of the first set 50 of the gemstones (using, e.g., tracks of the cross members), and the outer side walls 93, 92 are further retained by abutting to the corner prongs 71, 72, respectively. Similarly, for the second set 51 of the gemstones, notches 83, 84 thereof engage the respective members 65, 44, the mutually contacting sidewalls of the second set 51 of the gemstones engage the cross member 34 via their respective inner notches (using, e.g., tracks of the cross members), and the outer sidewalls abut the corner prongs 72, 73 for the third set 52 of the gemstones. Notches 86, 85 thereof engage the respective side members 62, 41 (using, e.g., tracks of the side members) via their respective inner notches, the mutually contacting sidewalls of the third set 52 engage the cross member 31, and the outer sidewalls abut the corner prongs 74, 73. For the fourth set 53 of the gemstones, notches 88, 87 thereof engage the side members 63, 42 (using, e.g., tracks on the side members) the mutually contacting sidewalls engage the cross member 32, and the outer sidewalls abut the corner prongs 71, 74 via their respective inner notches. When all of the sets of the gemstones i.e., the sets 50–54 are seated within their respective first and second frames 5, 10, 11, 12, 13, the table portions of the gemstones forming each of the first, second, third and fourth sets 50–53 extend along a plane that is parallel to the planes of the corresponding second frames 10–13, while the table portion of the gemstones forming the further set 54 extends along a plane which is parallel to the first plane and/or the second plane.

Figure 1B:
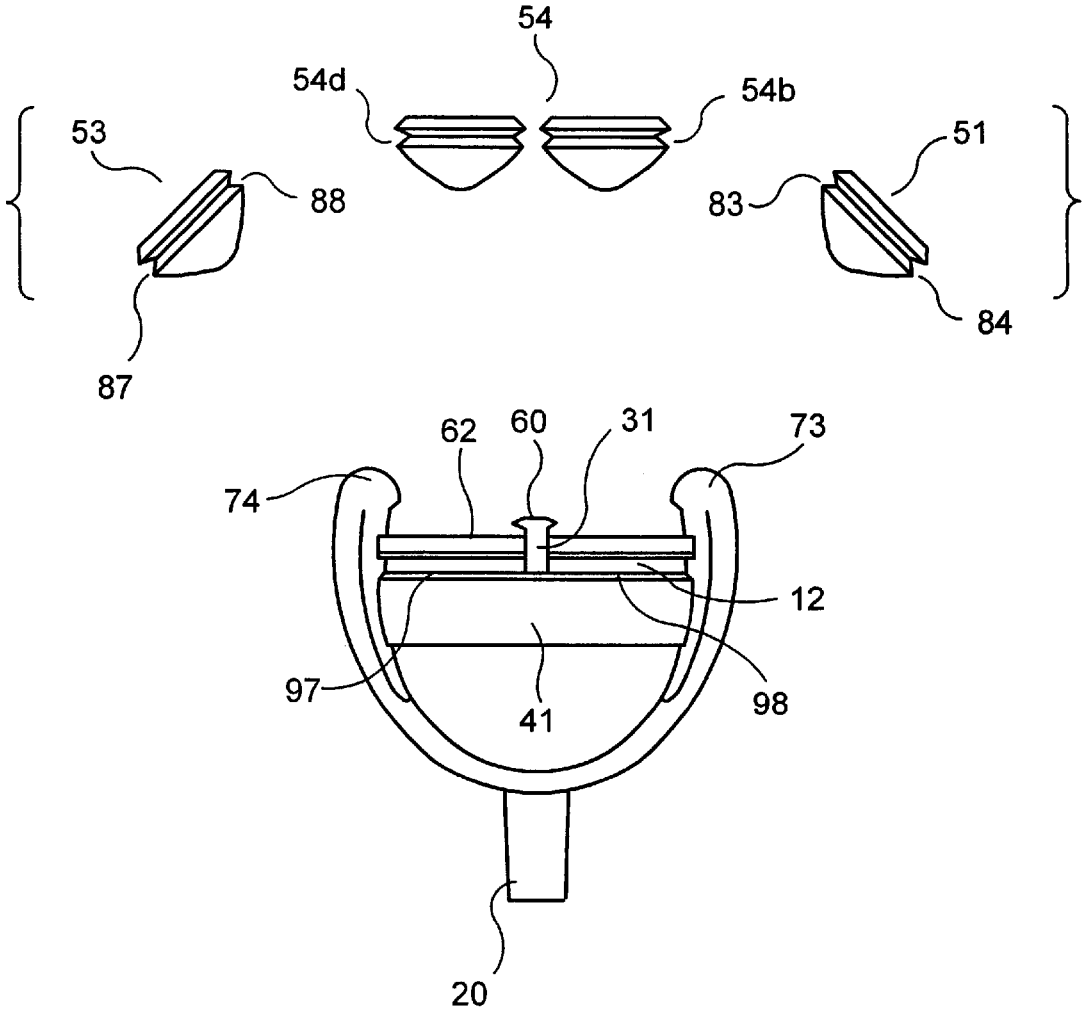
FIG. 1B shows a side view of the first embodiment of the jewelry setting illustrated in FIG. 1A.

FIG. 1B shows a side view of the first embodiment of the jewelry setting illustrated in FIG. 1A. In particular, the third 12 of the second frames 10–13 is shown in greater detail, as well as the configuration of the cross member 31 and the corner round prongs 73, 74.

Figure 2A:
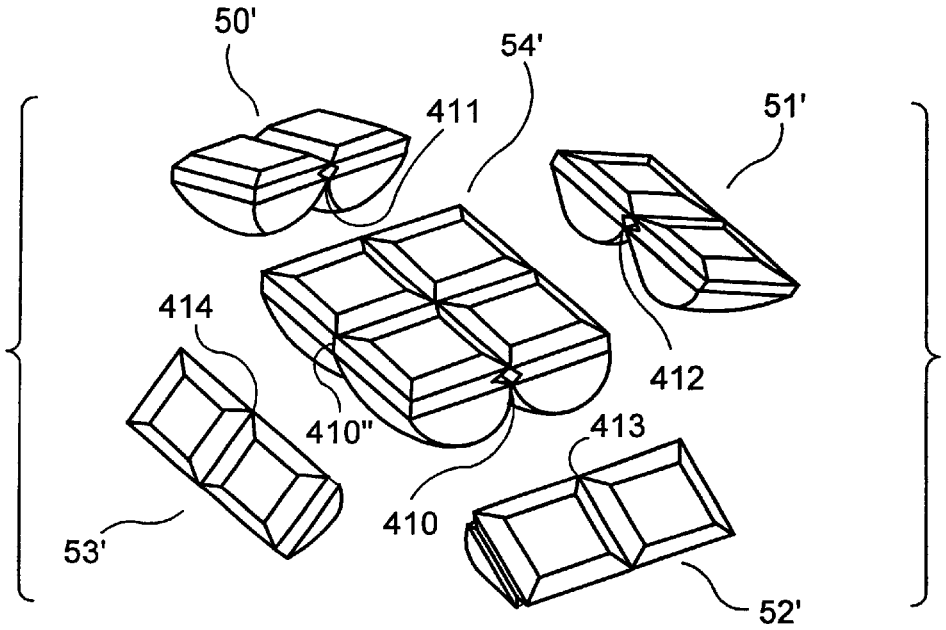
FIG. 2A shows a perspective view of a second variation of the first embodiment of the jewelry setting according to the present invention.
Figure 2A:
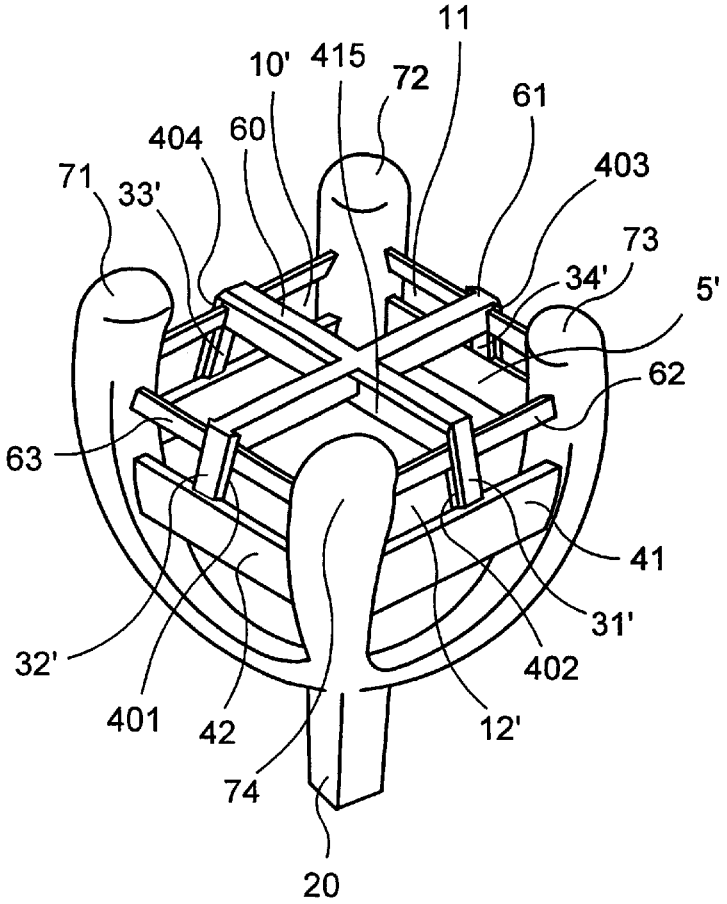

In a second variation of the first embodiment of the jewelry setting shown in FIG. 2A, the center gemstones 54' are provided in the gemstone seats of a frame 5'. Four sets of gemstones 50'–53' are provided in gemstone seats of respective frames 10'–13'. In the second variation of the second embodiment of the jewelry setting, a first cross member 31' of a respective frame 12' includes at least one first rail 402, a second cross member 32' of a respective frame 13' includes at least one second rail 401, a third cross member 33' of a respective frame 10' includes at least one third rail 404, and a fourth cross member 34' of a respective frame 11' includes at least one fourth rail 403. In particular, a respective notches (or grooves) of 411–413 are provided between (and preferably on the sides of) neighboring gemstones of each of the four sets of the gemstones 50'–53'. For example, at least one side of these gemstones has a groove. In addition, two sets of notches are provided between (and preferably on the sides of) the neighboring gemstones of the center gemstones 54' which has four gemstones. Each of the rails 401–404 can be provided on one side of the respective cross member, or on both sides thereof.

Figure 2B:
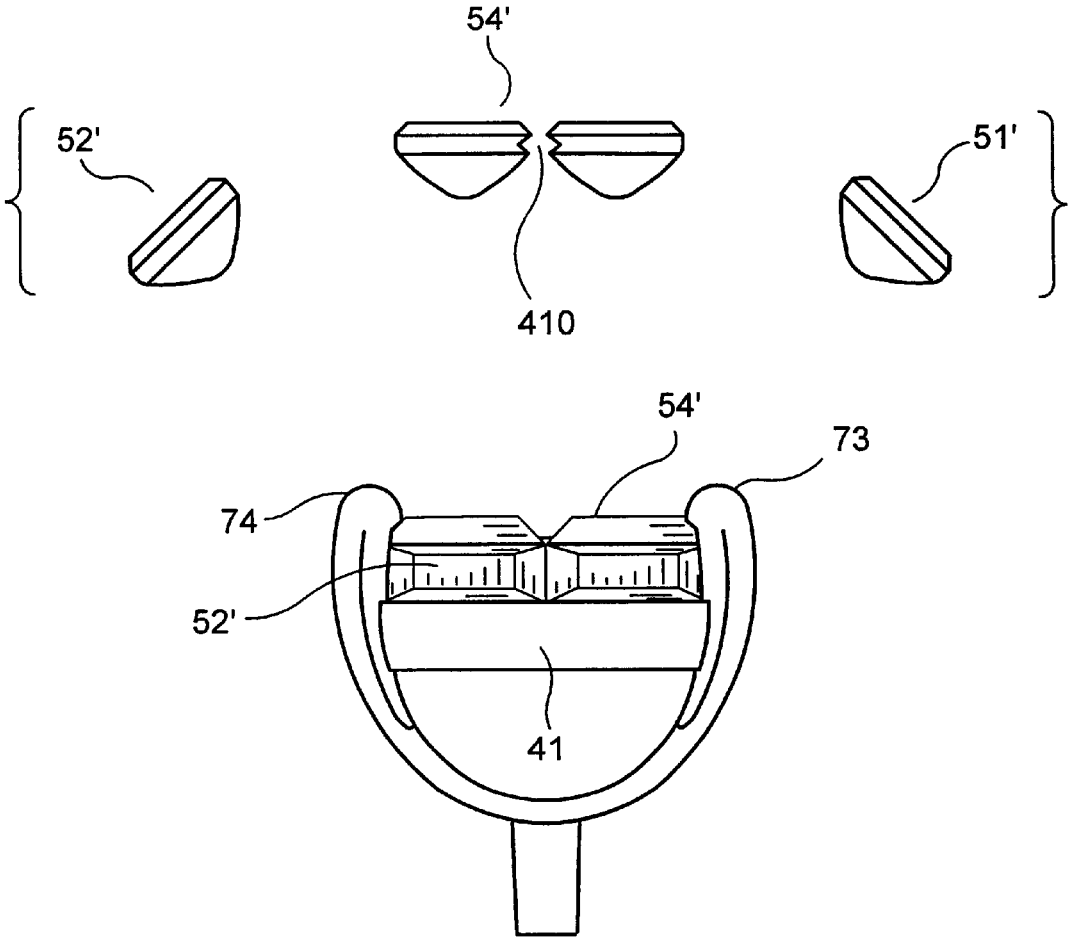
FIG. 2B shows a side view of the first embodiment of the jewelry setting illustrated in FIG. 2A.

As indicated above, the center gemstones 54' are can be seated in the frame 5'. In the case of a first set 50 of the gemstones, and the notches 410', 410" of the center gemstones 54' engage with rails 415 that are provided on the first and second crossbars 60, 61. In addition, corners of the outer gemstones of the center gemstones 54' abut to the four round corner prongs 7174. In this manner, the center gemstones 54' are held in the jewelry setting using the notches 410', 410" provided in the center gemstones 54', the rails 415 of the first and second crossbars 60, 61 and the four round corner prongs 71–74. In addition and as shown in FIGS. 2B and 2B, the first rail 401 abuts the notch 414 of the gemstones 53', the second rail 402 abuts the notch 413 of the gemstones 52', the third rail 404 abuts the notch 411 of the gemstones 50', and the fourth notch 403 abuts the notch 412 of the gemstones 51'. Furthermore, the gemstone set 50' is provided between and abuts the prongs 71, 72, the gemstone set 51' is provided between and abuts the prongs 72, 73, the gemstone set 52' is provided between and abuts the prongs 73, 74, and the gemstone set 53' is provided between and abuts the prongs 74, 71, In this manner, the sets of gemstones 51'–54' are secured in the jewelry setting.

Similar to the first variation of the first embodiment of the jewelry setting according to the present invention, the frames 10'–13' extend along different planes, each at the angles which may be acute (e.g., between 0° and 90°, and possibly inclusive of 0° and 90°), with respect to the plane of extension of the frame 5'. Indeed, each of the cross members 31', 32', 33', 34' extends at an axis which is provided at angle (with respect to an axis along which the first crossbar 60 extends) that is the same as the angle at which the respective one of the second portions 10'–13' extends.

Figure 3:
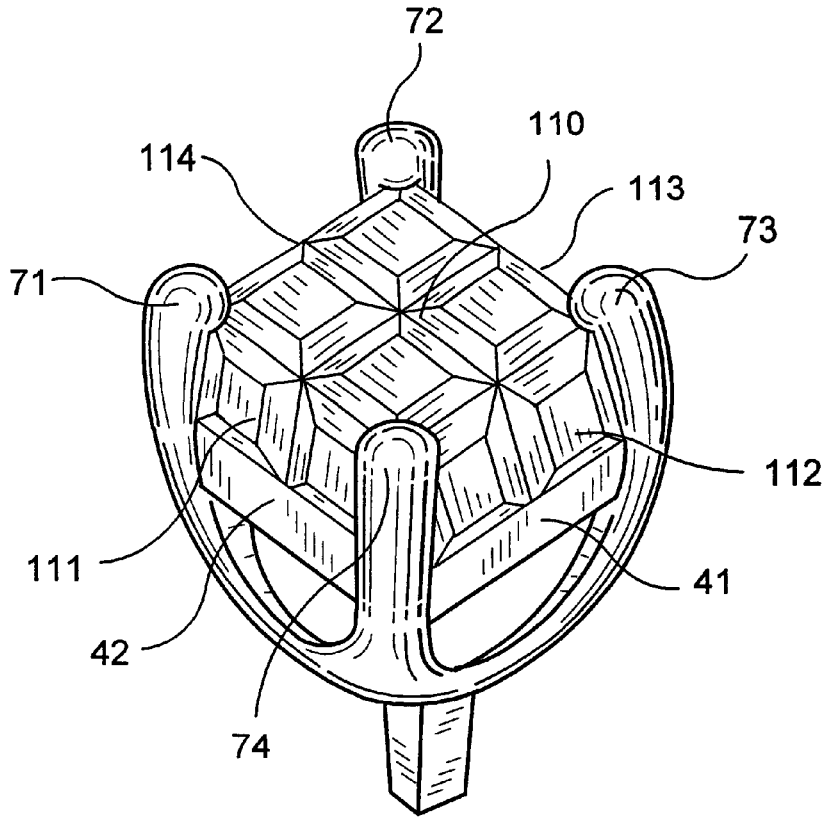
FIG. 3 shows a perspective view of the first embodiment with the gemstones provided therein.
Figure 4:
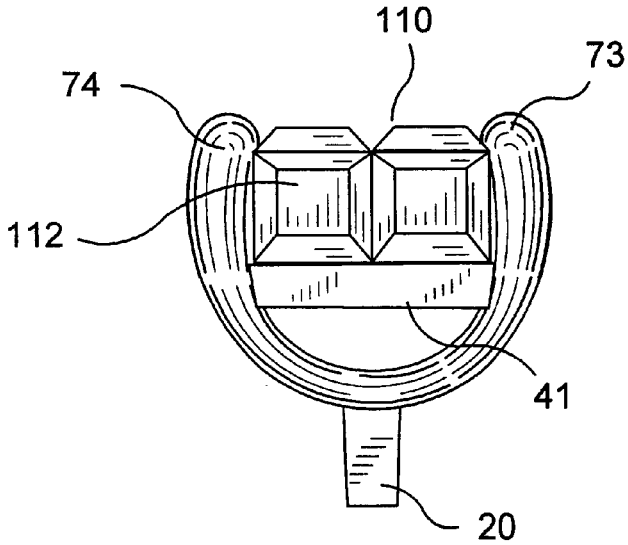
FIG. 4 shows a side view of the first embodiment of the jewelry setting with the gemstones mounted therein as illustrated in FIG. 3.

FIGS. 3 and 4 show perspective and side views, respectively, of the first embodiment of the jewelry setting of FIGS. 1A, 1B, 2A and 2B, with the gemstones facilitated therein. As shown in FIGS. 3 and 4, the resultant configuration provides a simulated appearance of a single larger gemstone, with an exposed center facet 110 and four side facets 111–114. In addition, the illustrated arrangement may provide an appearance of one large gemstone in a center portion of the jewelry setting, and four large rectangular gemstones on each side of the jewelry setting.

Figure 5A:
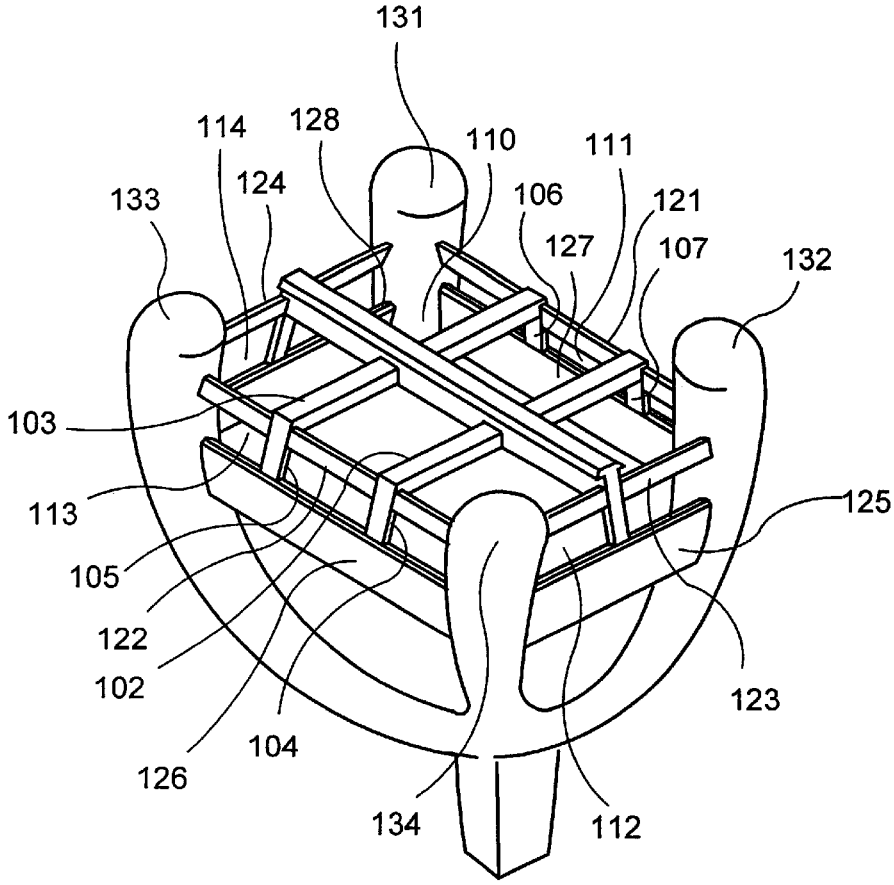
FIG. 5A shows a perspective view of a first variation of a second embodiment of the jewelry setting which is adapted for receiving six gemstones on the top portion thereof, as well as includes the round prongs.

FIG. 5A shows a first variation of a second embodiment of the setting which is capable of accommodating therein six center gemstones. A first rectangular frame 110 includes four side members 121–124, attached to four corner prongs 131–134, and includes a central crossbar 101 and other crossbars 102, 103. The central crossbar 101 can also extend along the same plane as the first and second crossbars 102, 103. The central crossbar 101 extends from substantially the middle of a side member 123 to substantially the middle of side member 124. The second crossbar 103 extends from a point on the side member 122, which is preferably one third of the distance from the corner prong 133 to the corner prong 134, to a point on the side member 121 which is preferably one third of the distance from the corner prong 131 to the corner prong 132. The third crossbar 102 extends from a point on side member 122, preferably two thirds of the distance from the corner prong 133 to the corner prong 134, to a point on side member 121, preferably two thirds of the distance from the corner prong 131 to the corner prong 132. The central crossbar 101 extends along a plane that is substantially above and parallel to the plane of the extension of the first and second crossbars 102, 103. The side members 121–124 of the first rectangular frame 110 and the crossbars 101–103 of the first rectangular frame 110 provide a configuration to facilitate six rectangular gemstones thereon. Similarly to the first variation of the first embodiment of the jewelry setting shown in FIGS. 1–4, the notches in the sidewalls of the six center gemstones 117 engage with the crossbars 101–103. The four corner prongs 131–134 abut the four corner gemstones of the center gemstones 117, and configured to assist the retention of these four corner gemstones in the jewelry setting.

Similar to the first embodiment of the jewelry setting shown in FIGS. 1A, 1B, 2A, 2B, 3 and 4, second rectangular frames 111–114 shown in FIG. 5A are connected to respective side members 124–127 and to the four corner prongs 131–134. A first 111 of the second rectangular frames 111–114 includes a first cross member 106 extending from a point on the side member 121, preferably one third of the distance from the corner prong 131 to the corner prong 132, to a point on the side member 127 preferably one third of the distance from the corner prong 131 to the corner prong 132. A second cross member 107 of the first 111 of the second frames 111–114 extends from a point on the side member 121, preferably two thirds of the distance from the corner prong 131 to the corner prong 132, to a point on the side member 127 preferably two thirds of the distance from the corner prong 131 to the corner prong 132. The cross members 106, 107 extend along a plane which is at an acute angle (e.g., between 0° and 90°, and possibly inclusive of 0° and 90°) with respect to a plane of extension of the first crossbar 101. Similar to the first embodiment of the jewelry setting shown in FIGS. 1A and 1B, the notches in the sidewalls of a set of three gemstones 119 engage with the cross members 106, 107 and with the side members 121, 127. The two round corner prongs 131, 132 abut the outer two gemstones of the set 119, and are configured to assist the retention of these two gemstones in the jewelry setting.

Figure 6:
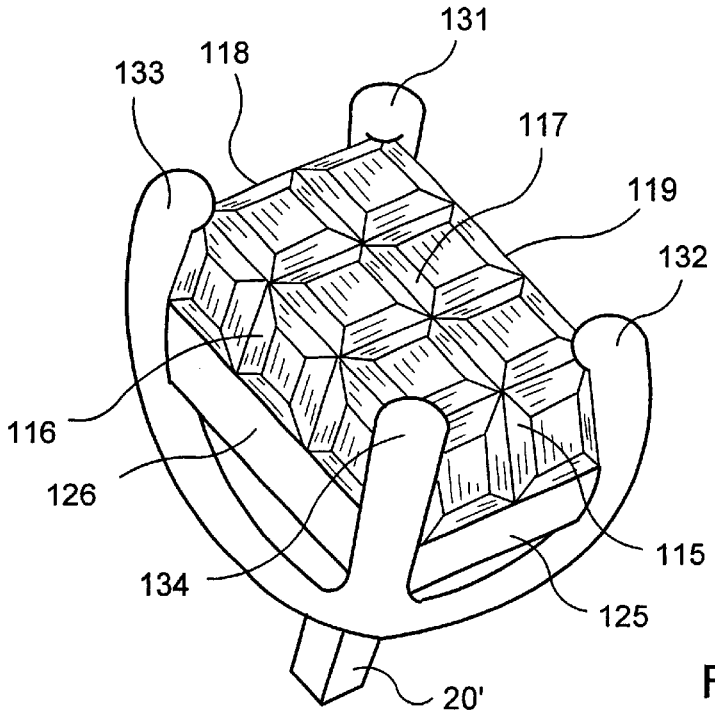
FIG. 6 shows a perspective view of the second embodiment with the gemstones mounted in the jewelry setting.

A set of the gemstones 116 (as shown in FIG. 6), provided on the opposite side of the jewelry setting in FIG. 5A, is formed in a similar manner. A second 113 of the second frames 111–114 includes a first cross member 105 which extends from a point on the side member 122, preferably one third of the distance from the corner prong 133 to the corner prong 134, to a point on the side member 126 preferably one third of the distance from the corner prong 133 to the corner prong 134. A second cross member 104 of the second 113 of the second frames 111–114 extends from a point on the side member 122, preferably two thirds of the distance from the corner prong 133 to the corner prong 134, to a point on the side member 126, preferably two thirds of the distance from corner prong 133 to the corner prong 134. The cross members 104, 105 extend along a plane which is at an acute angle (e.g., between 0° and 90°, and possibly inclusive of 0° and 90°) with respect to a plane of extension of the first crossbar 101. The notches in the sidewalls of a set of three gemstones 116 engage with the cross members 104, 105 and with the side members 122, 126. The two round corner prongs 133, 134 abut the two outer gemstones of the set 116, and are configured to assist in the retention of the gemstones of the set 116 in the jewelry setting.

Figure 5B:
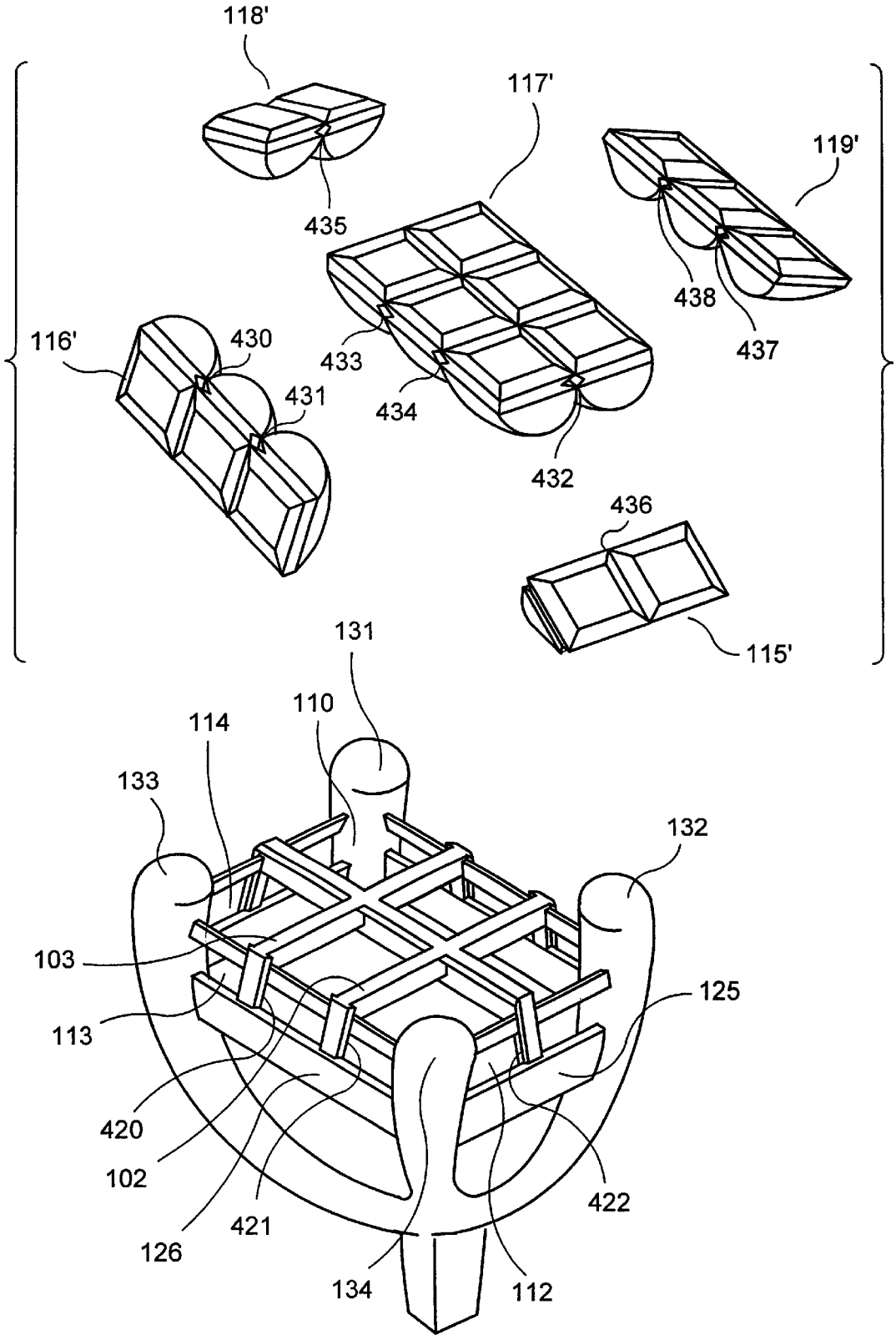
FIG. 5B shows a perspective view of a second variation of the second embodiment of the jewelry setting according to the present invention.

FIG. 5B shows a second variation of the second embodiment of the jewelry setting. In this variation of the second embodiment, the crossbars 101–103 have respective rails 420–422. The center gemstones 117' have notches 432–434 provided between (and preferably on the sides of) the adjacent gemstones. The notches 432–434 abut the rails 420–422 to secure the center gemstones 117' in the jewelry setting. Furthermore, the four corner prongs 131–134 abut the four corner gemstones of the center gemstones 117', and are configured to assist the retention of these four corner gemstones in the jewelry setting.

The sets of gemstones 115', 118' each have one respective notch 436, 435. Each of the notches 436, 435 abuts the rail 422 of the jewelry setting. The sets of gemstones 116', 119' each have two respective notches (i.e., notches 430, 431 for the gemstones 116', and notches 437, 438 for the gemstones 119'). Each of the notches 436, 435 abuts the rail 422 of the jewelry setting, the notches 430, 438 abut the rail 420, and the notches 431, 437 abut the rail 421. Also, the gemstones 115' are secured between the corner prongs 132, 134, the gemstones 116' are secured between the corner prongs 133, 134, the gemstones 118' are secured between the corner prongs 131, 133, and the gemstones 119' are secured between the corner prongs 131, 132.

FIG. 6 shows a perspective view of the second embodiment of the jewelry setting according to the present invention. In this embodiment, the set of six center gemstones 117 is provided in two rows of three gemstones in the first frame as shown in FIGS. 5A, 5B with the gemstones provided therein. Each of two sets of facing gemstones 116, 119 (or 116', 119') includes three gemstones. Each of two sets of gemstones 115, 118 (or 115', 118') includes two gemstones. The configuration of the sets 115, 118 (or 115', 118') of the sets 112, 114 is substantially similar to the configuration of the first embodiment shown in FIGS. 1–4. As described above, the sets each with three stones 116, 119 (or 116', 119'), and the set 117 (or 117') of gemstones in the first frame 10, are provided in the jewelry setting shown in FIG. 5.

Figure 7A:
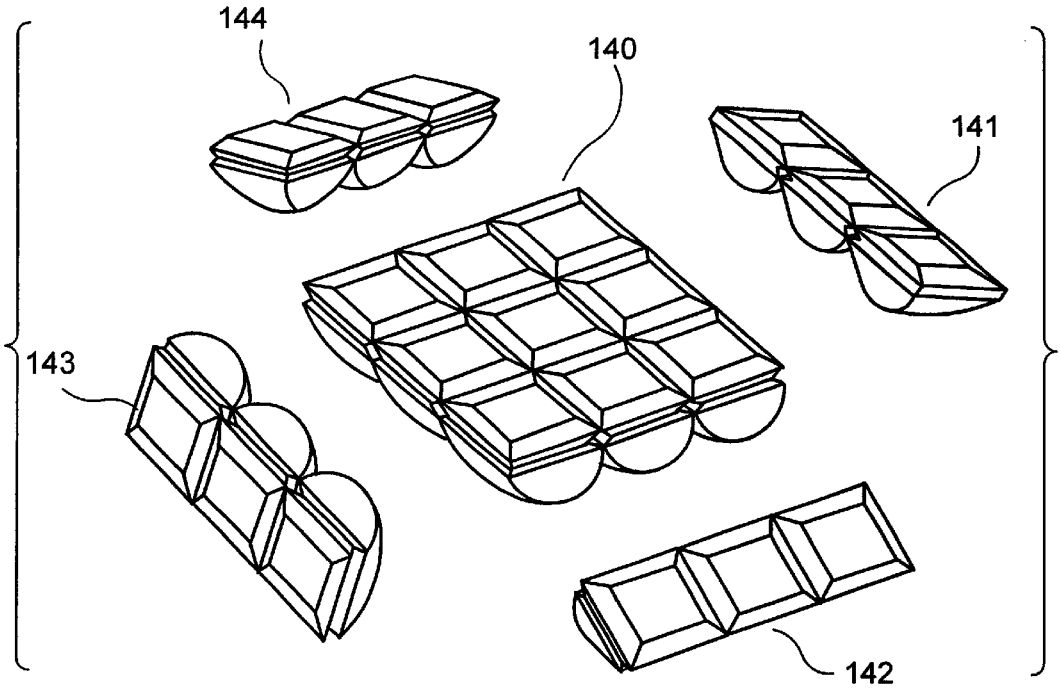
FIG. 7A shows a perspective view of a first variation of a third embodiment of the jewelry setting, which is similar to the jewelry setting of FIG. 1, for providing nine gemstones on the top portion and three gemstones on each side portion of the jewelry setting.
Figure 7A:
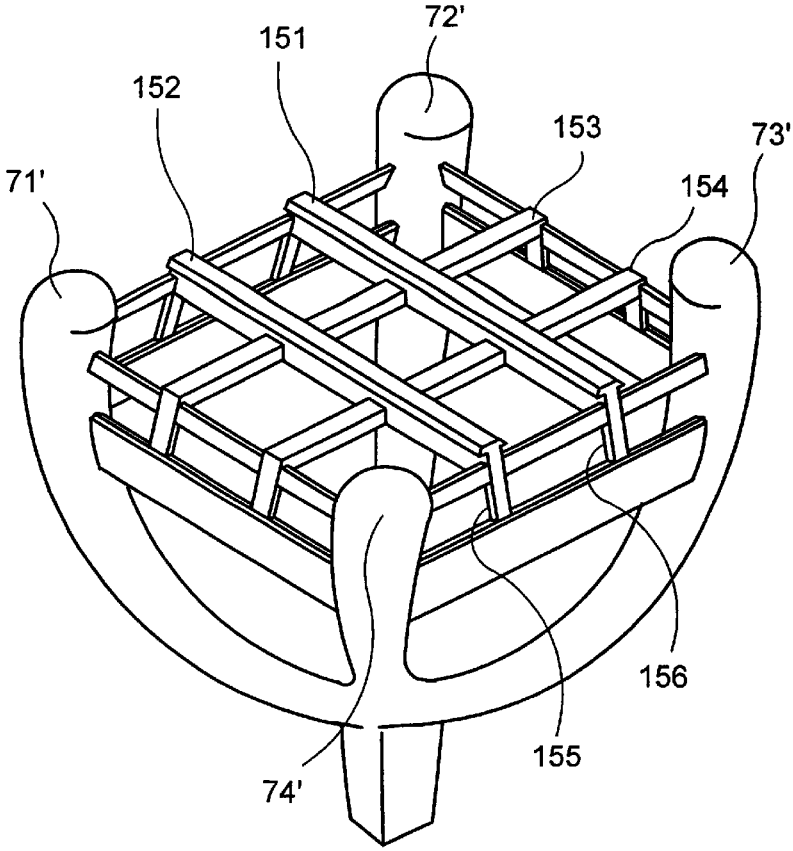

FIG. 7A shows a perspective view of a first variation of a third embodiment of the jewelry setting of the present invention. In this variation of the third embodiment, nine rectangular gemstones can be facilitated in its top frame, while three gemstones can be mounted in each of its side frames. The placement of a set of nine gemstones 140 is accomplished by using four cross bars 151–154. Two of the crossbars 151, 152 extend in a first direction. Another two of the crossbars 153, 154 extend in a second direction which is preferably perpendicular to the first direction. The crossbars 151, 152 extend in a plane that is substantially parallel to and above the crossbars 153, 154. The engagement of the set of nine gemstones 140 with the two sets of parallel crossbars 151–154 is also substantially similar as provided for the second embodiment of the jewelry setting illustrated in FIGS. 5A and 6. The crossbars 151–154 can also extend along the same plane. The four sets of gemstones 141–144, each having three gemstones, are configured in the same manner as the sets 116, 119 illustrated in FIG. 5A. Cross members 155, 156 are also provided so that the set of the gemstones 142 can be secured in the jewelry setting of FIG. 7A. Similarly to the first and second embodiments illustrated in FIGS. 1A, 1B and 5A, the cross members 155, 156 of the third embodiment extend along a plane that is provided at an acute angle (e.g., between 0° and 90°, and possibly inclusive of 0° and 90°) with respect to a plane along which the crossbars 151, 152 extend.

Figure 7B:
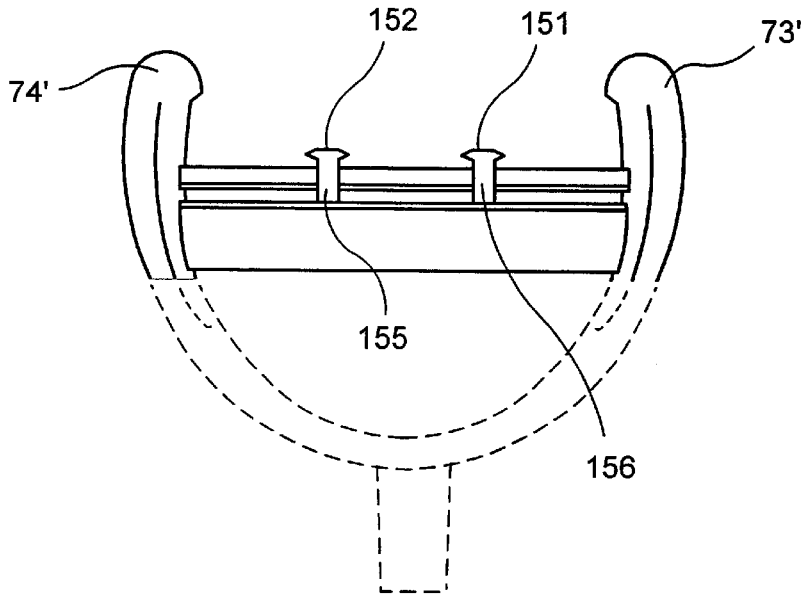
FIG. 7B shows a side view of the third embodiment of the jewelry setting illustrated in FIG. 7A.

FIG. 7B shows a side view of the first variation of the third embodiment of the jewelry setting with the gemstones removed. The two crossbars 151, 152 that engage the set of nine gemstones 140, and the two cross members 155, 156 that engage the set of three gemstones 142 are illustrated.

Figure 8B:
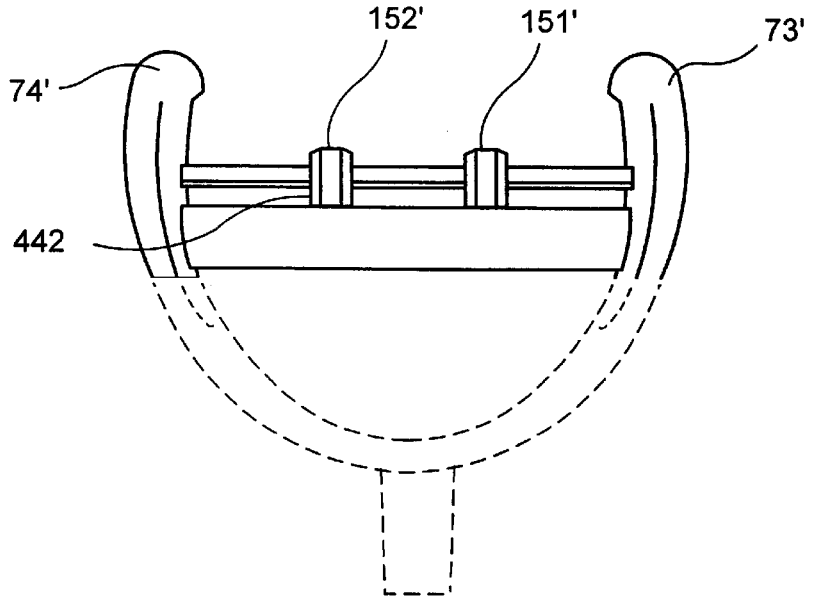
FIG. 8B shows a side view of the third embodiment of the jewelry setting illustrated in FIG. 8A.
Figure 8A:
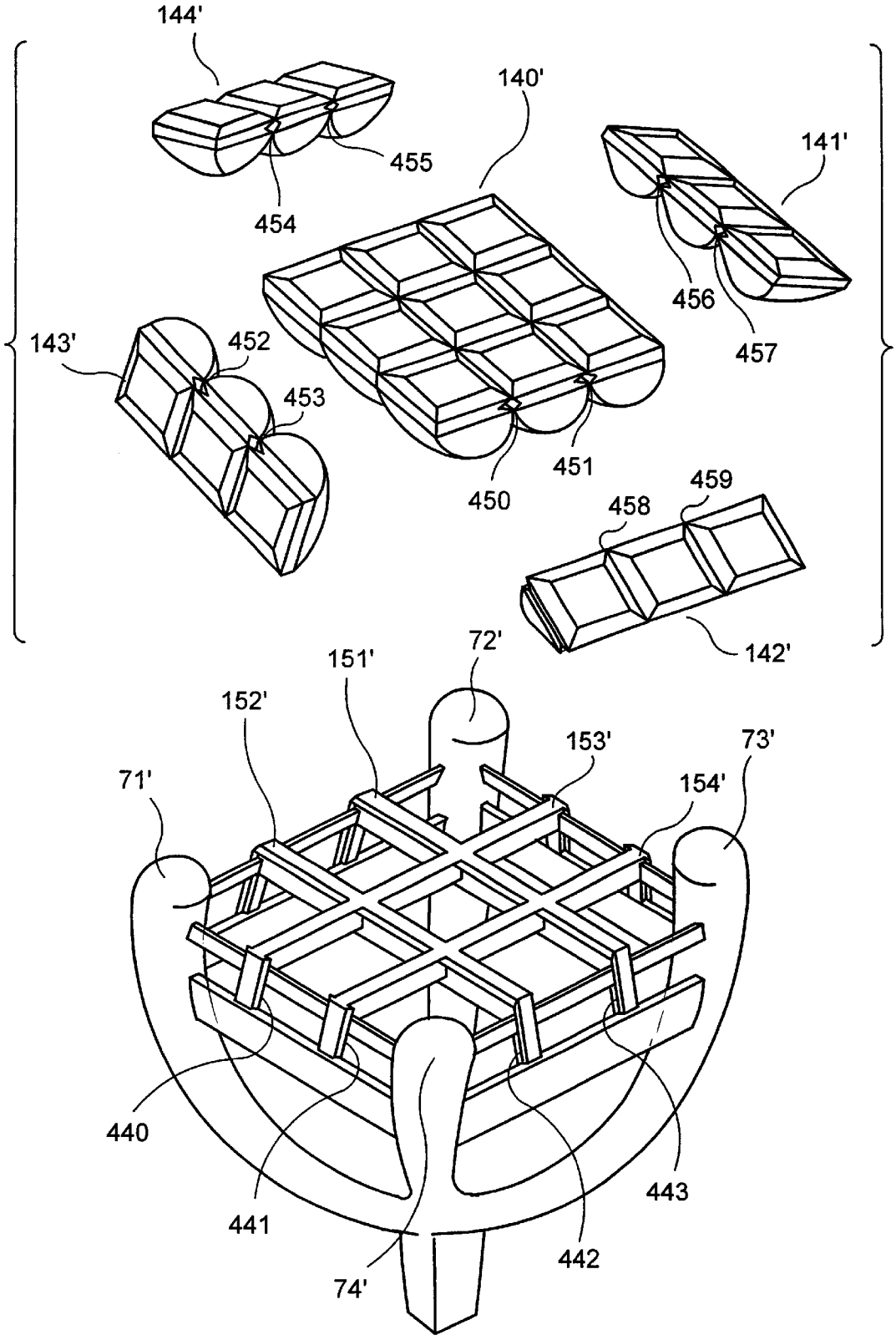
FIG. 8A shows a perspective view of a second variation of the third embodiment of the jewelry setting according to the present invention.

FIG. 8A shows a perspective view of a second variation of the third embodiment of the jewelry setting according to the present invention. In this variation of the third embodiment, the placement of a set of nine gemstones 140' is also accomplished by using the four cross bars 151–154. The engagement of the set of nine gemstones 140 with the two sets of parallel crossbars 151–154 is also substantially similar as provided for the second embodiment of the jewelry setting illustrated in FIG. 5B. The four sets of gemstones 141'–144', each having three gemstones, are configured in the same manner as the sets 116', 119' illustrated in FIG. 5B. Crossbars 151–154' with rails 440–443 are also provided so that the set of the gemstones 140'–1 44' can be secured in the jewelry setting. Similarly to the first variation of the third embodiment illustrated in FIGS. 7A and 7B, the cross members of the third embodiment extend along a plane that is provided at an acute angle (e.g., between 0° and 90°, and possibly inclusive of 0° and 90°) with respect to a plane along which the crossbars 151, 152 extend.

Figure 9A:
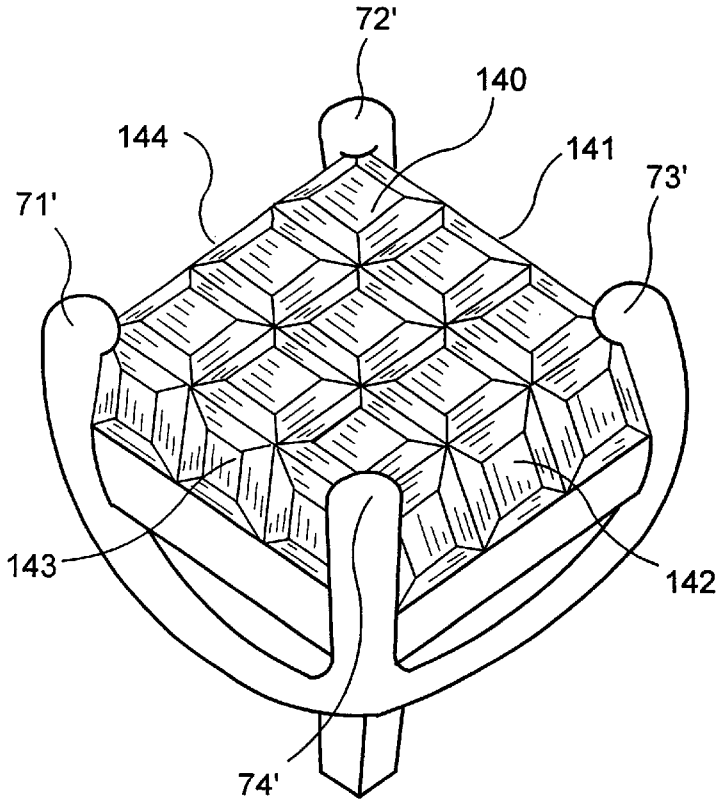
FIG. 9A shows a perspective view of the third embodiment with the gemstones provided in the top and side portions thereof.
Figure 9B:
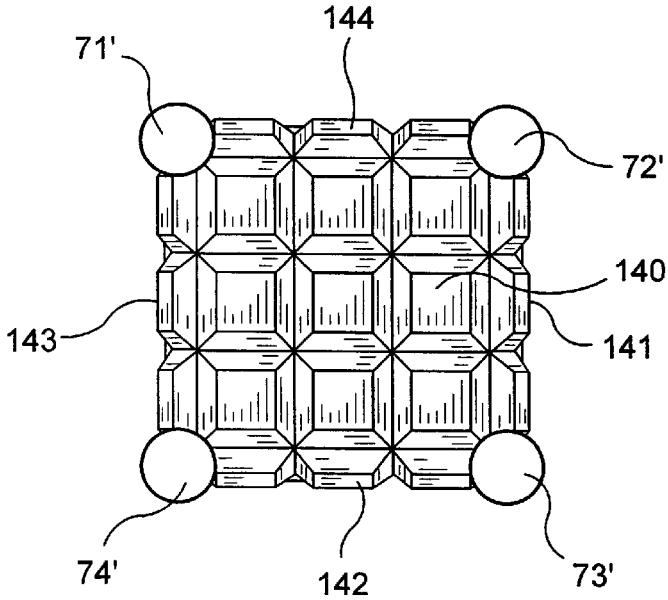
FIG. 9B shows a top view of the third embodiment of the jewelry setting illustrated in FIG. 9A.

FIG. 8B shows a side view of the second variation of the third embodiment of the jewelry setting with the gemstones removed. The two crossbars 151', 152' that engage notches 458, 459 of the gemstone set 142' and notches 450, 451 of the three gemstone set 140' are illustrated. FIGS. 9A and 9B show a perspective and top views, respectively, of the third embodiment of the jewelry setting, with the gemstones mounted therein. As can be seen in FIGS. 9A and 9B, the set of nine gemstones 140 extends along a plane that is provided at an acute angle (e.g., between 0° and 90°, and possibly inclusive of 0° and 90°) with respect to the plane of extension of each of the sets of three gemstones 141–144.

Figure 10A:
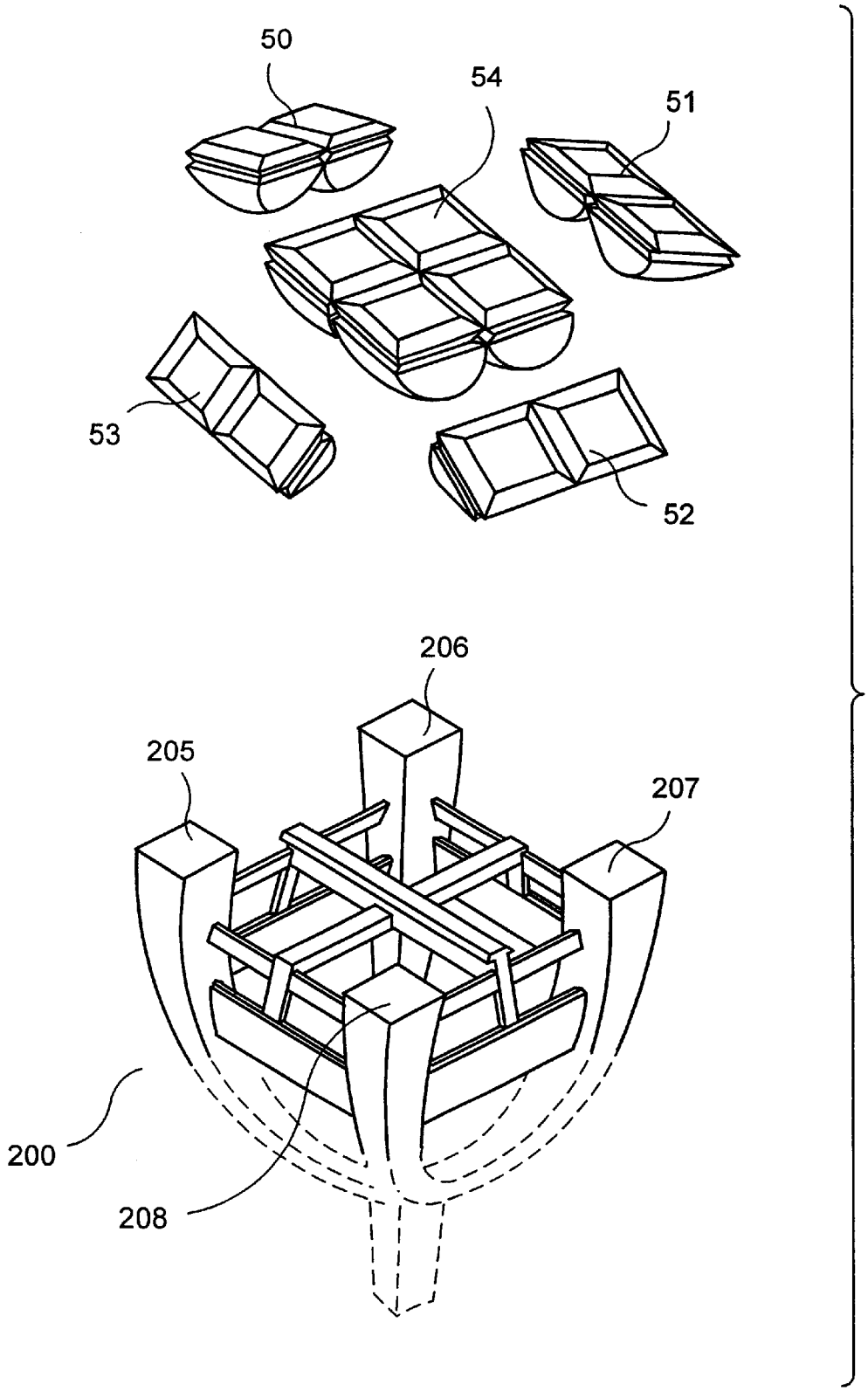
FIG. 10A shows a perspective view of a first variation of a fourth embodiment of the jewelry setting having square prongs, and capable of facilitating four gemstones in the top portion and two gemstones in the side portions thereof.
Figure 10B:
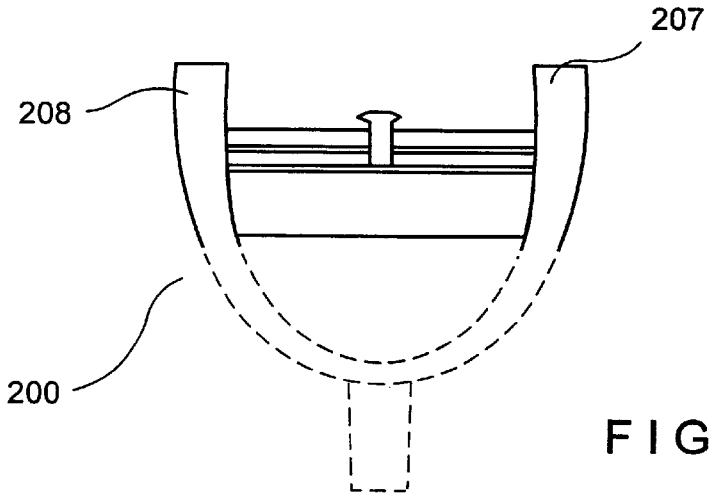
FIG. 10B shows a side view of the fourth embodiment of the jewelry setting illustrated in FIG. 10A, with the gemstones removed.

Further embodiments of the present invention which utilize square corner prongs are illustrated in FIGS. 10A–24B. In particular, FIG. 10A shows a perspective view of a first variation of a fourth embodiment of the jewelry setting having square cross-section corner prongs 205–208 prior to mounting of the gemstones. This variation of the fourth embodiment is similar to the first variation of the first embodiment shown in FIG. 1A, except that the prongs 205–208 of the forth embodiment have a square or rectangular shape (as opposed to the round-shaped prongs 71–74 of the first embodiment). FIG. 10B shows a side view of the first variation of the fourth embodiment of the jewelry setting illustrated in FIG. 10A, without the gemstones mounted therein.

Figure 12:
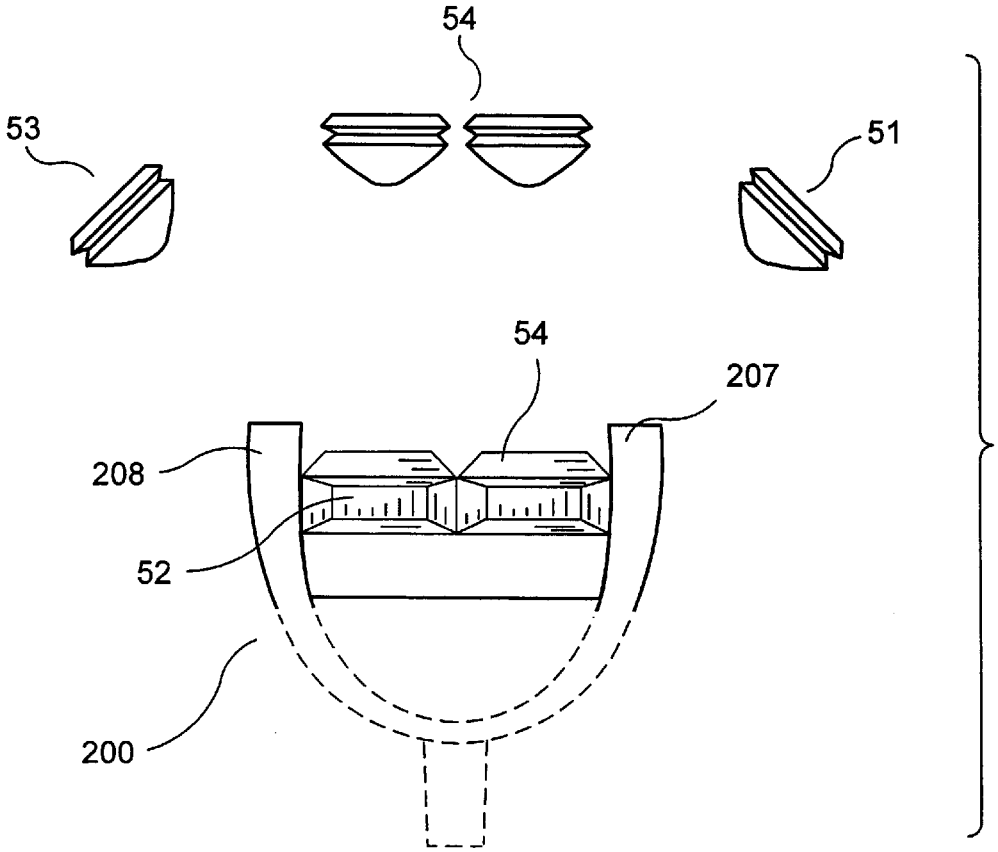
FIG. 12 shows a side view of the fourth embodiment of the jewelry setting.
Figure 11A:
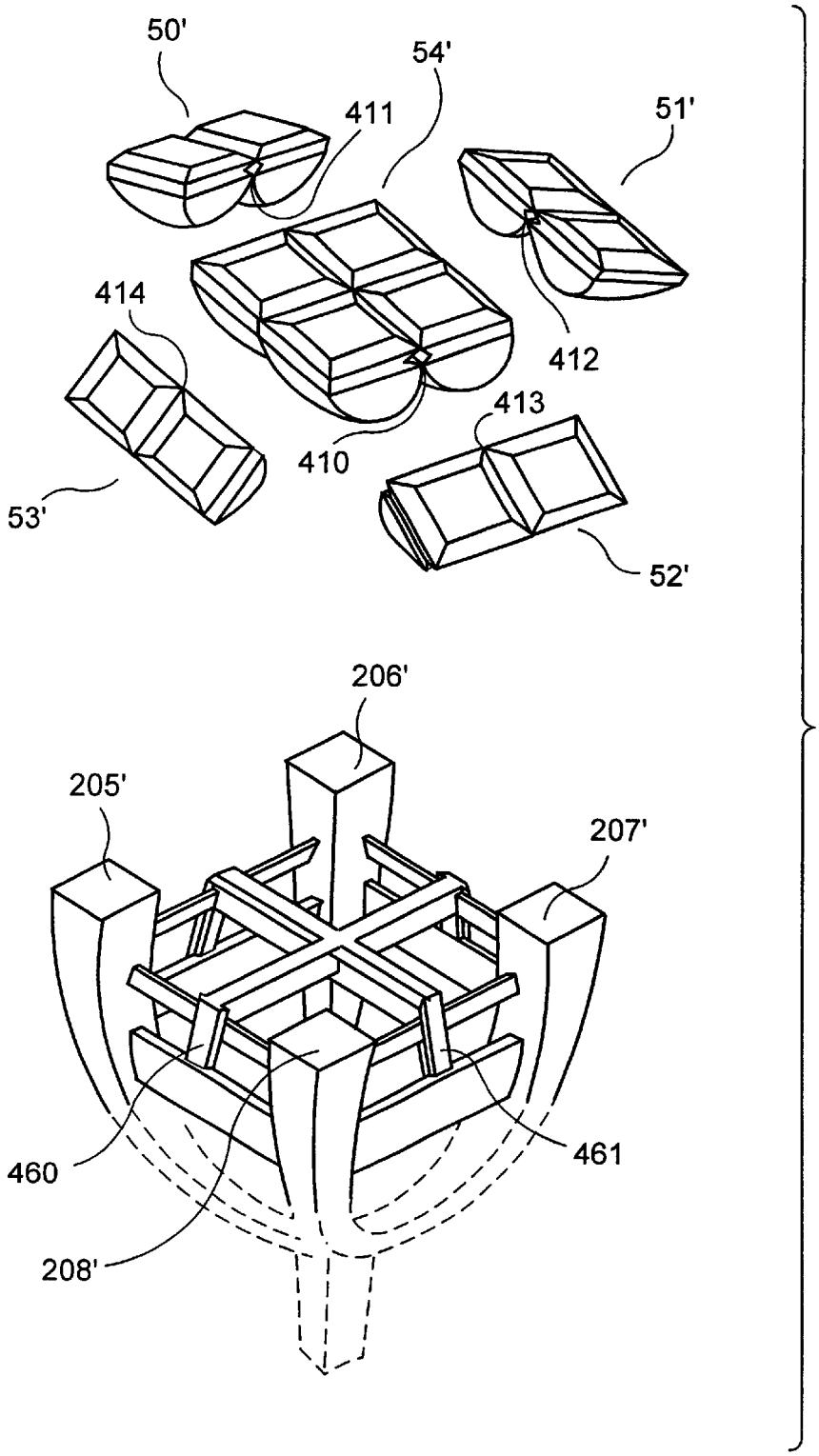
FIG. 11A shows a perspective view of a second variation of the fourth embodiment of the jewelry setting according to the present invention.
Figure 11B:
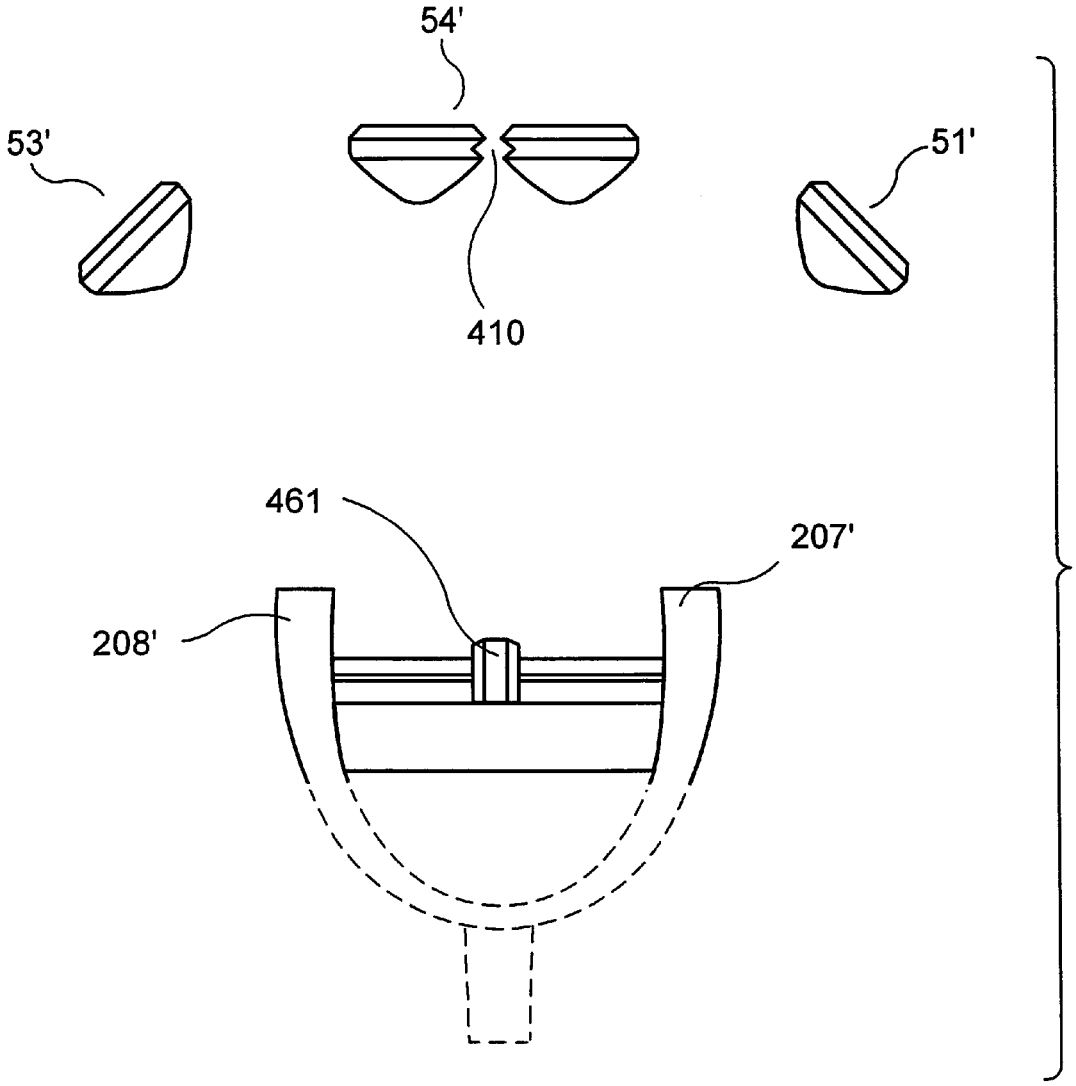
FIG. 11B shows a side view of the fourth embodiment of the jewelry setting illustrated in FIG. 11A, with the gemstones removed.

FIGS. 11A and 11B show perspective view and side views, respectively, of a second variation of the fourth embodiment of the jewelry setting having square cross-section corner prongs 205'–208' prior to mounting of the gemstones. This variation of the fourth embodiment is similar to the second variation of the first embodiment shown in FIG. 2A, except that (and as provided in the first variation) the prongs 205'–208' of the forth embodiment have a square or rectangular shape. FIG. 12 shows a side view of the fourth embodiment of the jewelry setting illustrated in FIGS. 10A–11B, with gemstones mounted therein.

Figure 13:
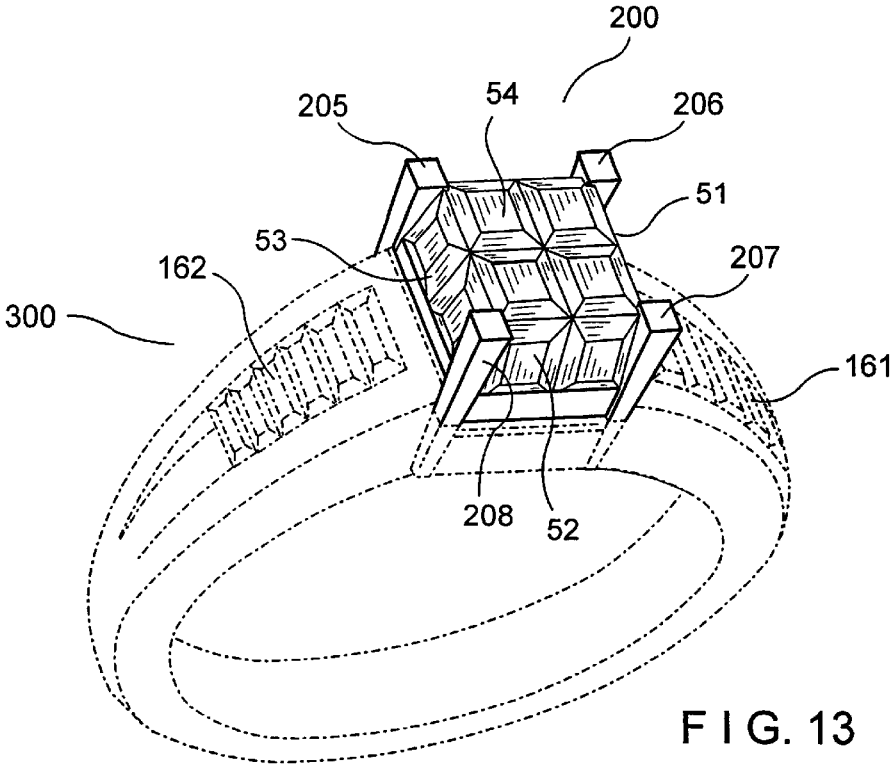
FIG. 13 shows a perspective view of the fourth embodiment of the jewelry setting mounted in a ring.
Figure 14:
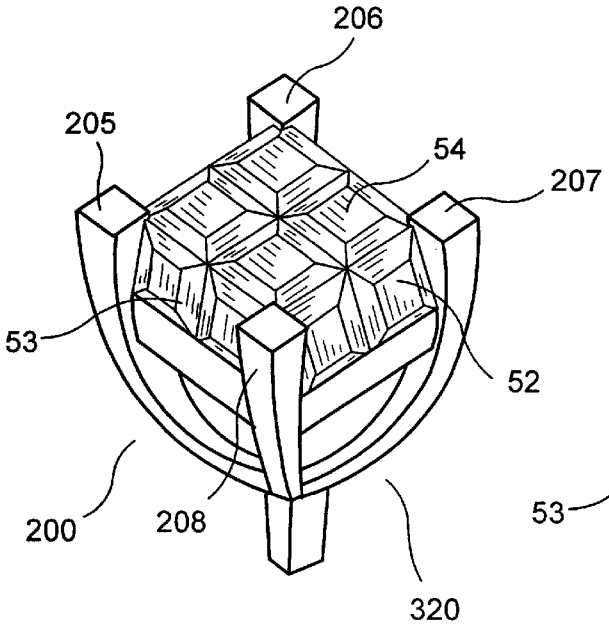
FIG. 14 shows another perspective view of the fourth embodiment of the jewelry setting.
Figure 15:
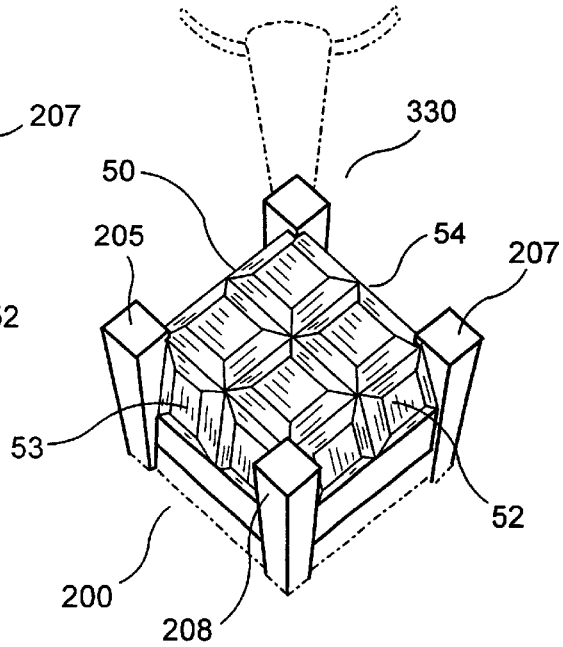
FIG. 15 shows a perspective view of the fourth embodiment mounted in a pendant.
Figure 16:
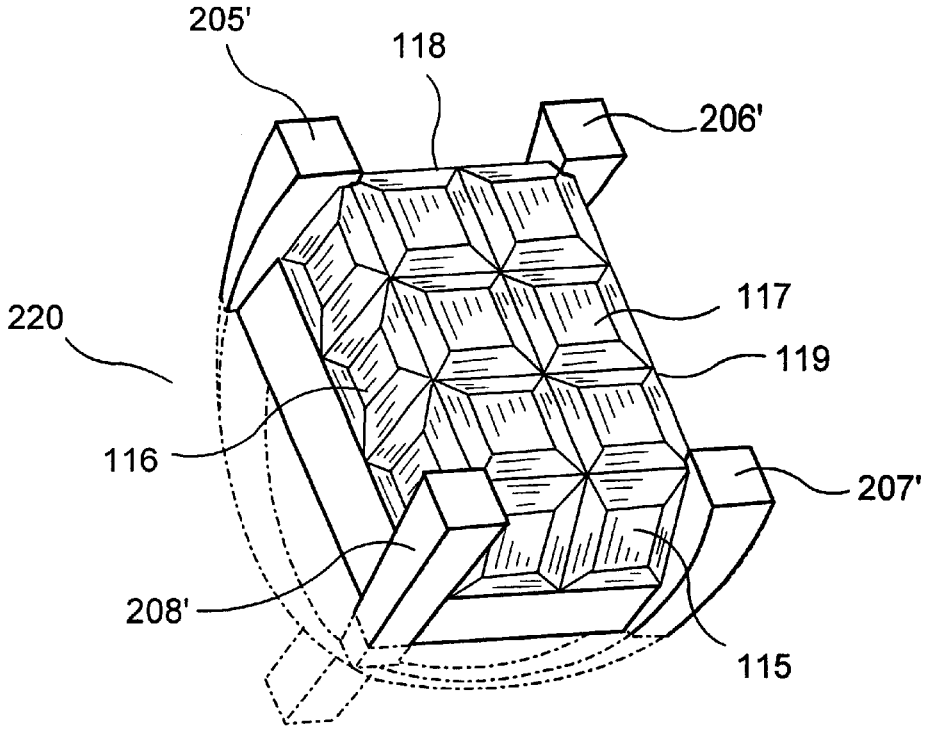
FIG. 16 shows a perspective view of a fifth embodiment of the jewelry setting having square corner prongs, and capable of facilitating six gemstones on the top portion thereof.
Figure 17A:
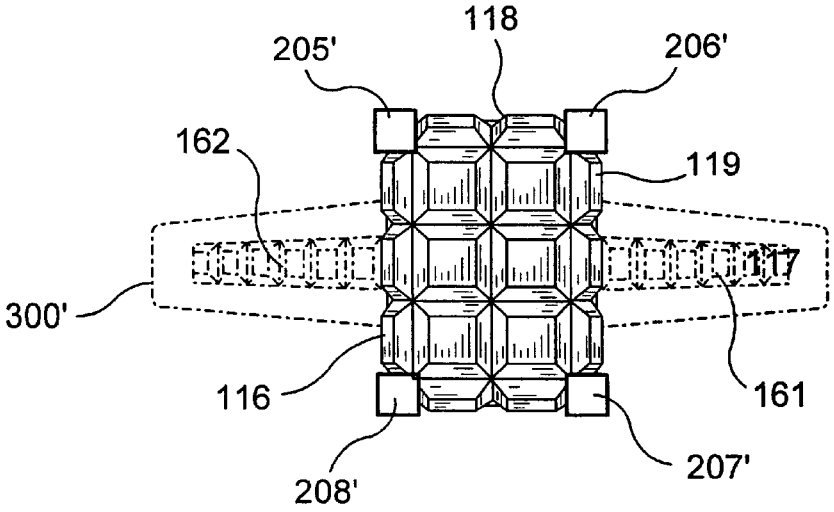
FIGS. 17A, 17B, 17C show top, front view and side views, respectively, of the fifth embodiment of the jewelry setting mounted in a ring.
Figure 17B:
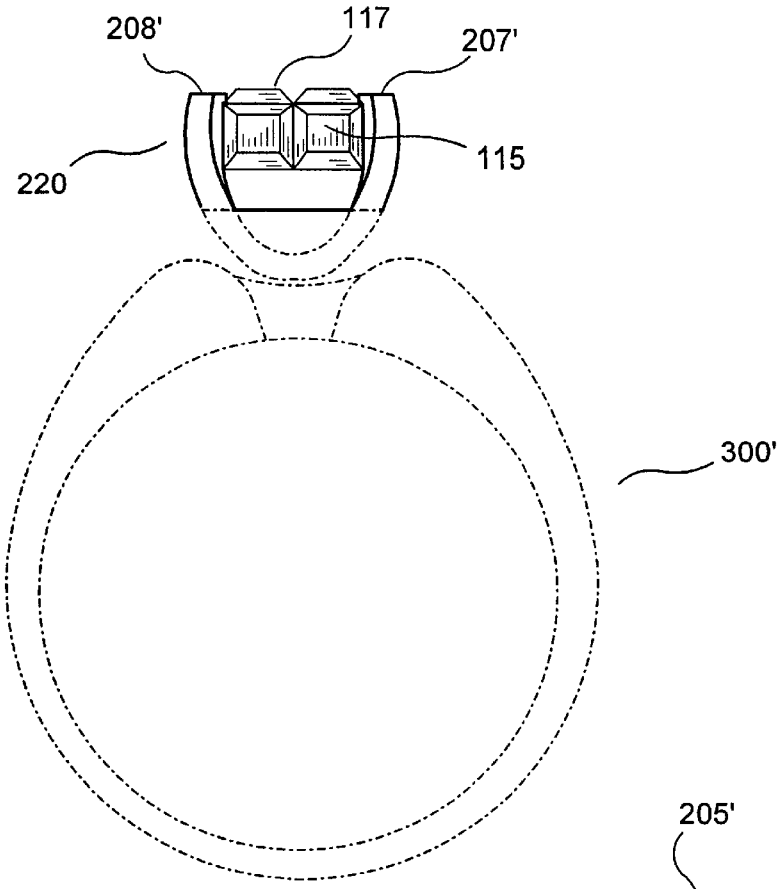
Figure 17C:
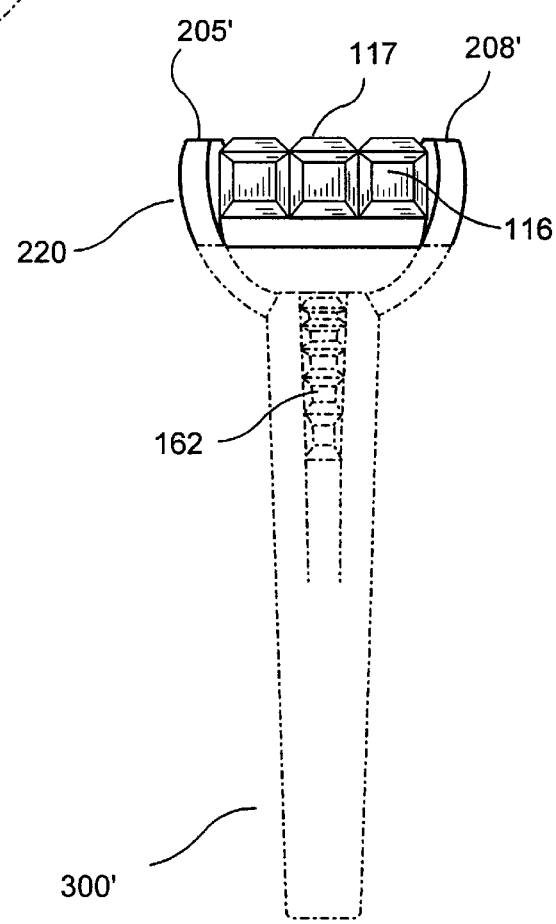

FIG. 13 illustrates the fourth embodiment with the square corner prongs 205–208 (or 205'–208') provided on a ring 300. Matching rectangular stones 161, 162 can also be disposed on a concave surface of the ring 600 adjacent to the jewelry setting. FIG. 14 shows the fourth embodiment of the jewelry setting with the square corner prongs 205–208 (or 205'–208') joined underneath the jewelry setting in a curved manner. FIG. 15 shows the fourth embodiment of the jewelry setting provided in a pendant 330 or the like. FIG. 16 shows a perspective view of a fifth embodiment of the jewelry setting of the present invention with a set of six center gemstones 117 (or 117'), two sets of three side gemstones 116, 119 (or 116', 119'), and two sets of two side gemstones 115, 118 (or 115', 118'), along with the square corner prongs 205–208 (or 205'–208'). FIGS. 17A, 17B and 17C show top, front and side views, respectively, of the fifth embodiment of the jewelry setting 220 shown in FIG. 16, with the four corner prongs 205"–208" extended to join beneath the jewelry setting 220, and thereby attached to a ring 300'. This embodiment also shows the matching rectangular stones 162 on the concave surfaces of the ring 300' that are adjacent to the jewelry setting 220.

Figure 18:
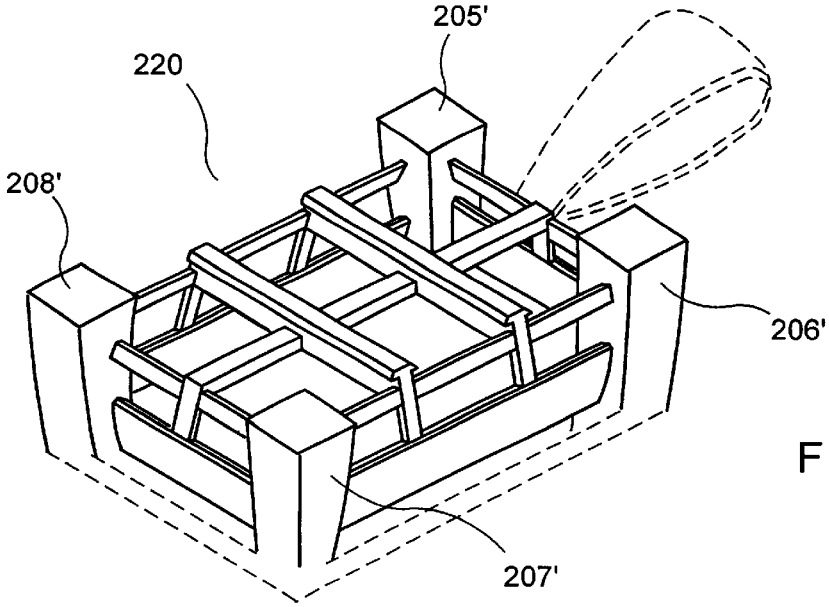
FIG. 18 shows a perspective view of the fifth embodiment of the jewelry setting with the gemstones removed.
Figure 19:
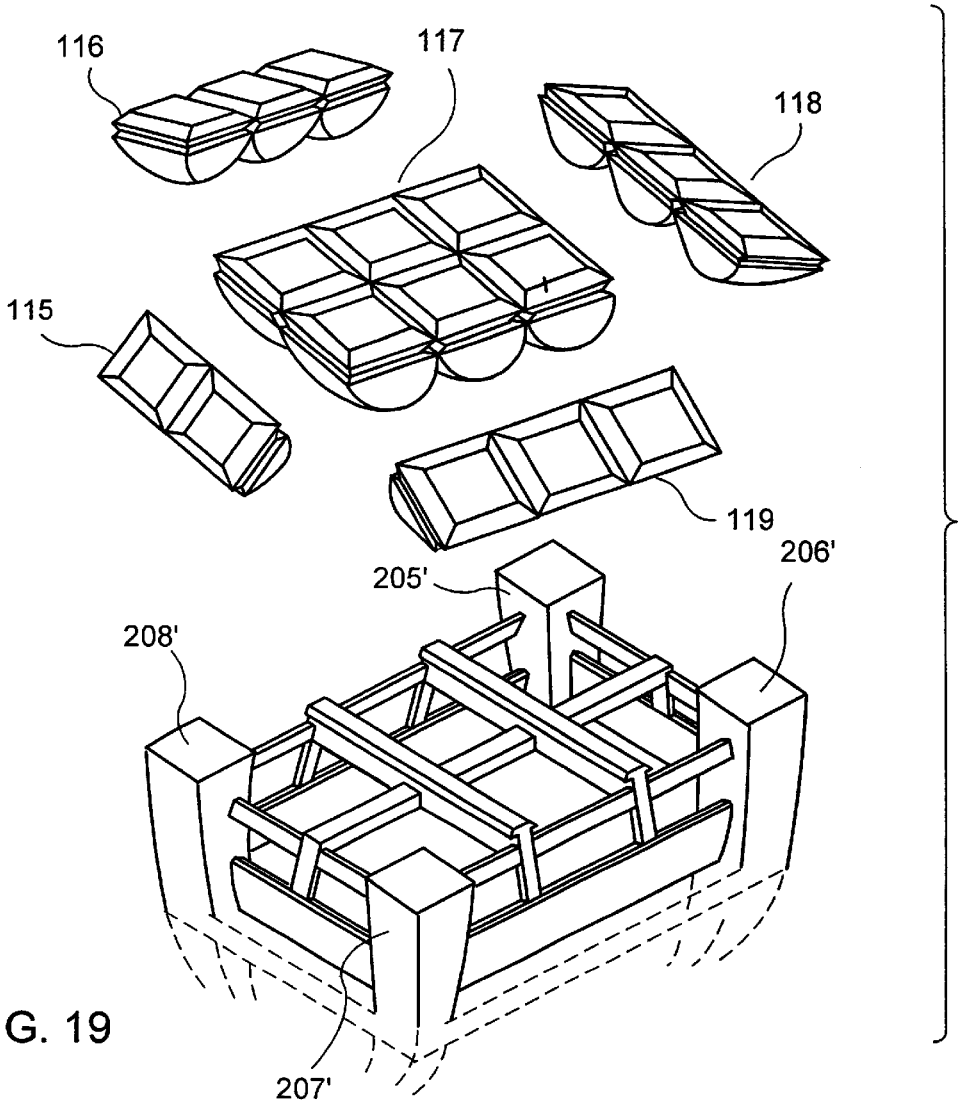
FIG. 19 shows a perspective view of the fifth embodiment of the jewelry setting, with the gemstones configured to be mounted in the jewelry setting.

FIG. 18 shows the fifth embodiment of the jewelry setting 220 illustrated, without the gemstones provided therein, which can be used for a pendant or the like. FIG. 19 illustrates a perspective view of the fifth embodiment of the jewelry setting 220, with the square cross-section corner prongs 205'–208. It should be understood that the configuration similar to one shown in FIG. 5B can also be utilized in the configuration of the jewelry setting (and the gemstones) of FIGS. 18 and 19.

Figure 20:
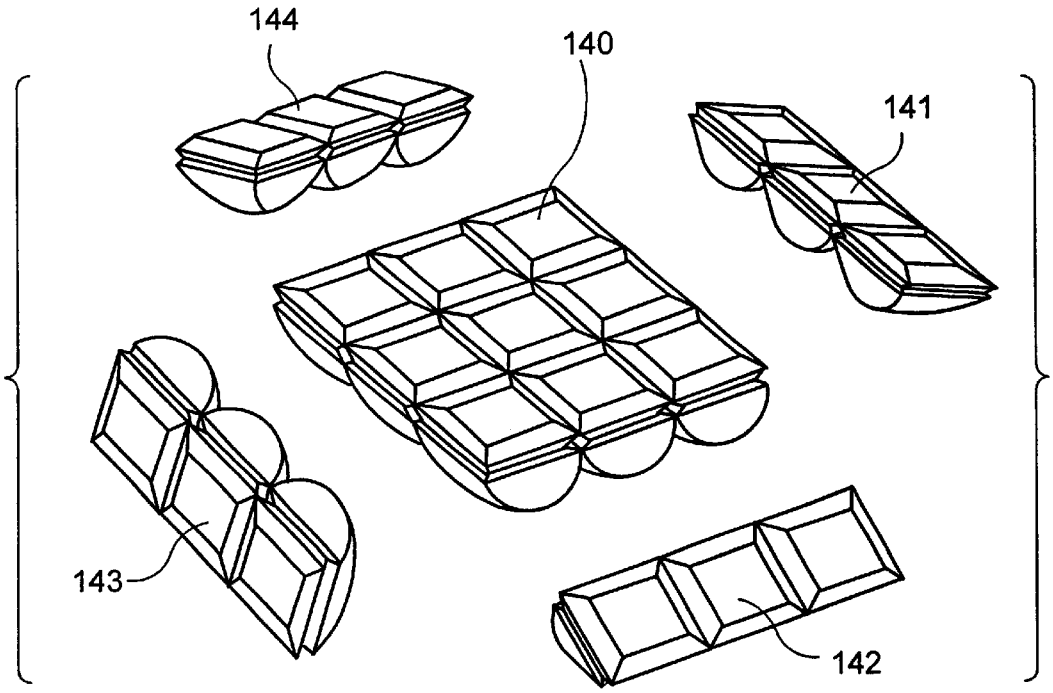
FIG. 20 shows a perspective view of a sixth embodiment of the jewelry setting with square prongs, and capable of facilitating nine gemstones on the top portion and three gemstones on each of the side portions thereof.
Figure 20:
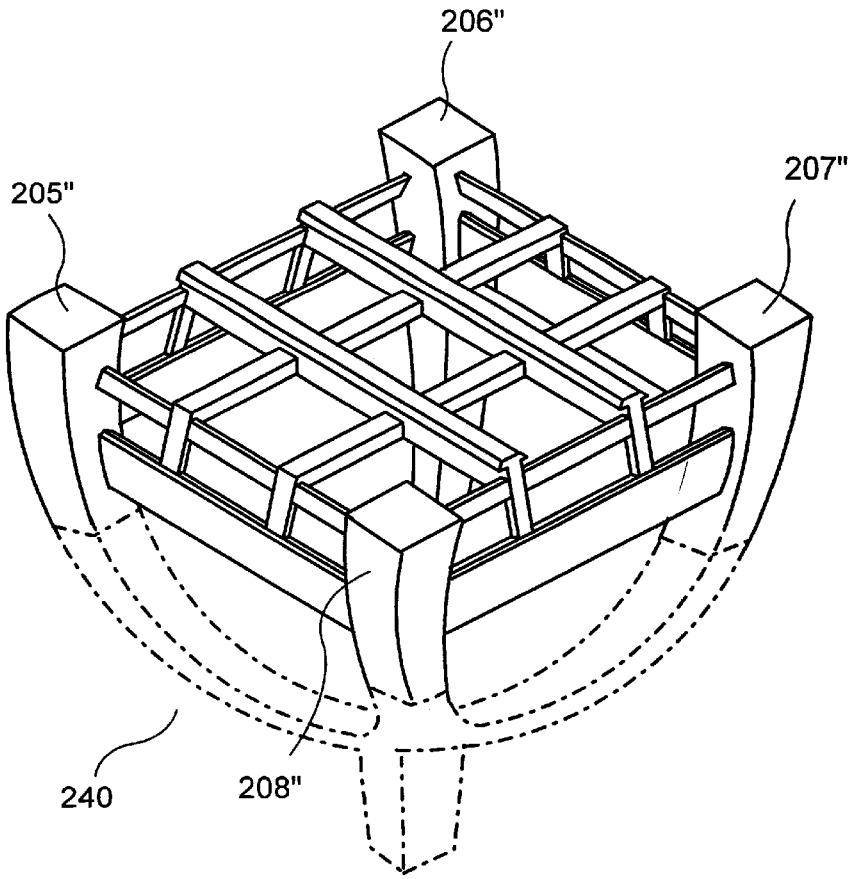
Figure 21:
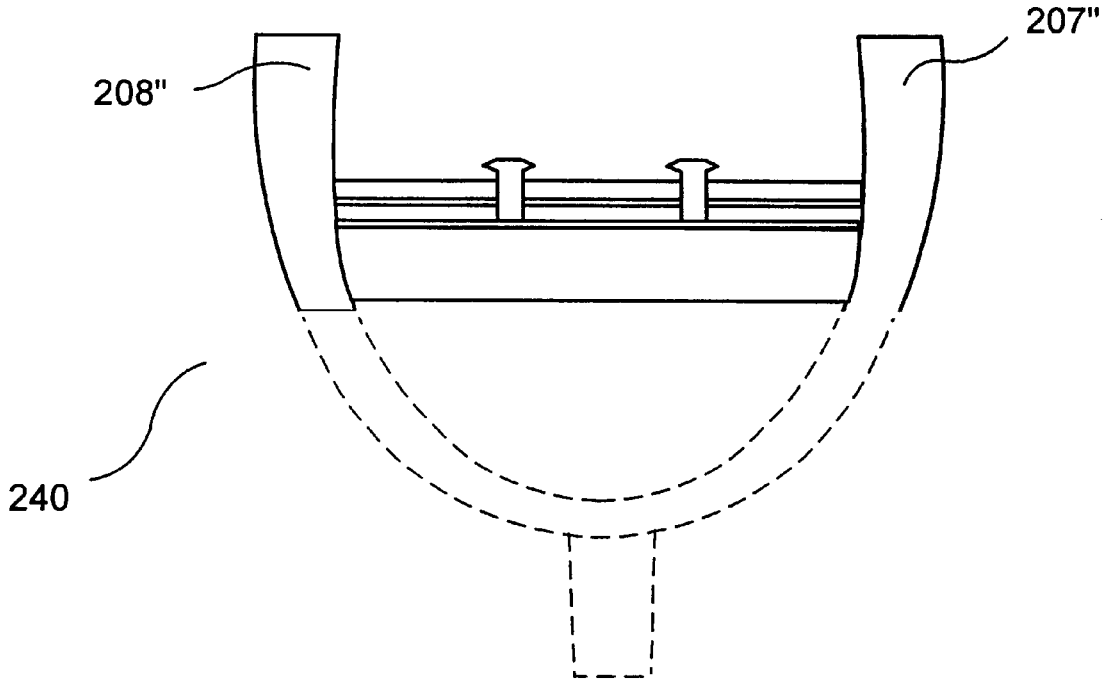
FIG. 21 shows a side view of the sixth embodiment of the jewelry setting of FIG. 20, with the gemstones removed.
Figure 22:
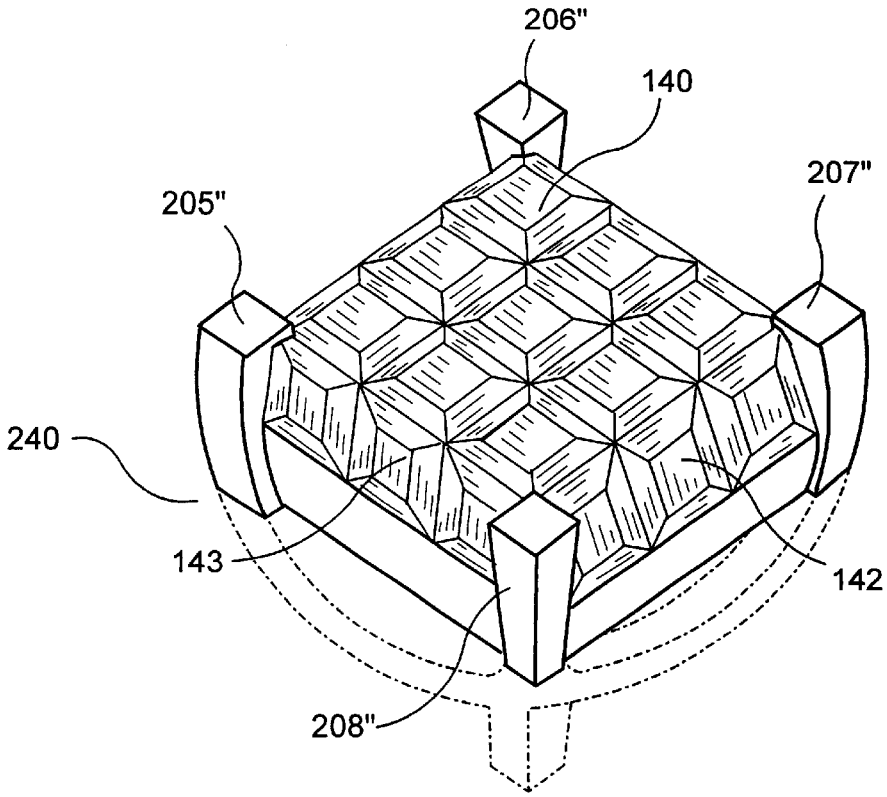
FIG. 22 shows a perspective view of the sixth embodiment of the jewelry setting illustrated in FIG. 20, with the gemstones facilitated therein.
Figure 23:
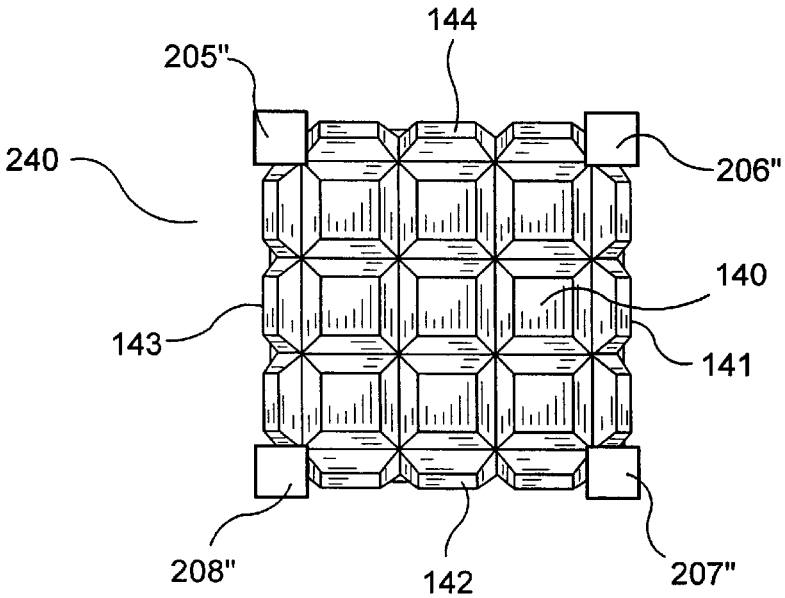
FIG. 23 shows a top view of the sixth embodiment of the jewelry setting illustrated in FIG. 22.
Figure 24A:
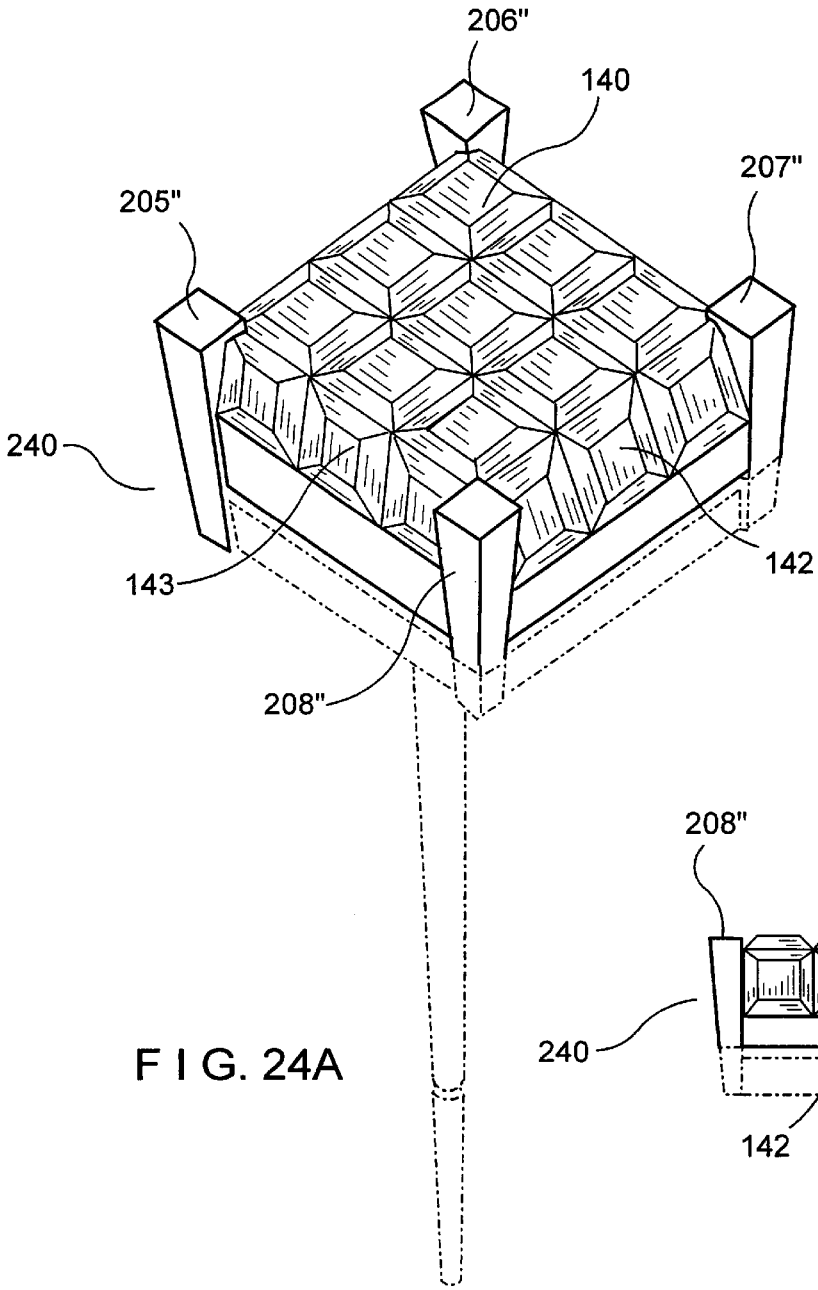
FIGS. 24A and 24B show perspective and side views, respectively, of the sixth embodiment of the jewelry setting of FIG. 22 mounted in an ornamental pin or an earring.
Figure 24B:
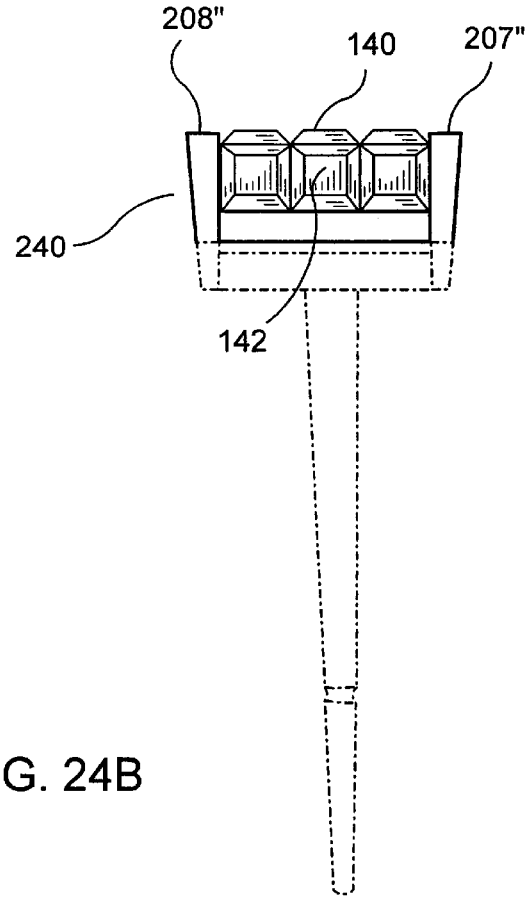

FIG. 20 illustrates a perspective view of a sixth embodiment of the jewelry setting 240 of the present invention with the square corner prongs 205"–208", a set of nine center gemstones 140, and four sets of three side gemstones 141–144. A side view of the sixth embodiment is shown in FIG. 21, without the gemstones mounted therein. A perspective view of the assembled jewelry setting of FIG. 20 is shown in FIG. 22. FIG. 23 shows a top view of the sixth embodiment (illustrated in FIG. 22) of the jewelry setting 240. FIGS. 24A and 24B show perspective and side views, respectively, of the sixth embodiment of the jewelry setting 240 mounted on a post, which may be suitable for a use as an earing or the like. It should be understood that the configuration similar to one shown in FIGS. 8A and 8B can also be utilized in the configuration of the jewelry setting (and the gemstones) of FIGS. 20–24B.

Figure 25A:
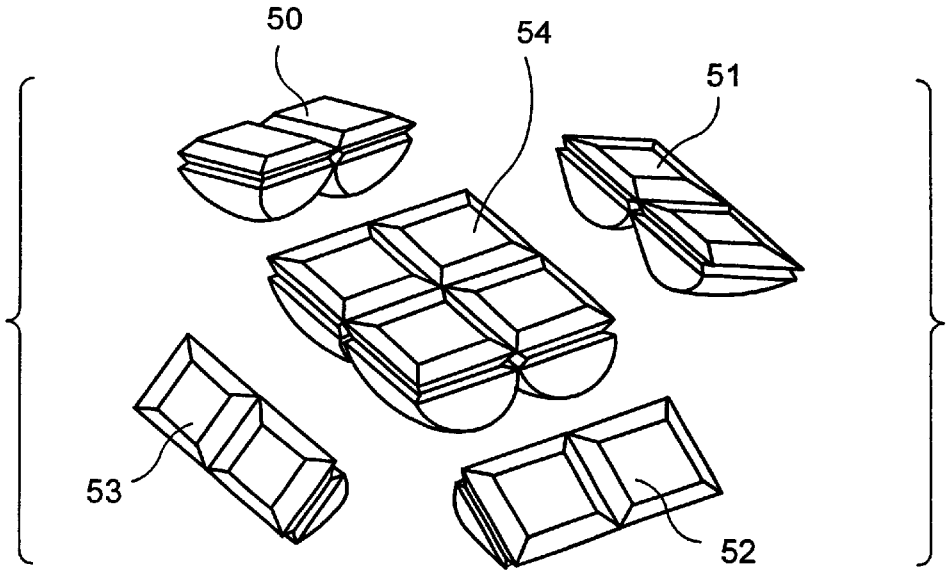
FIG. 25A shows a perspective view of a first variation of a seventh embodiment of the jewelry setting having V-shaped or L-shaped prongs, and adapted for holding four gemstones to be provided on the top portion thereof.
Figure 25A:
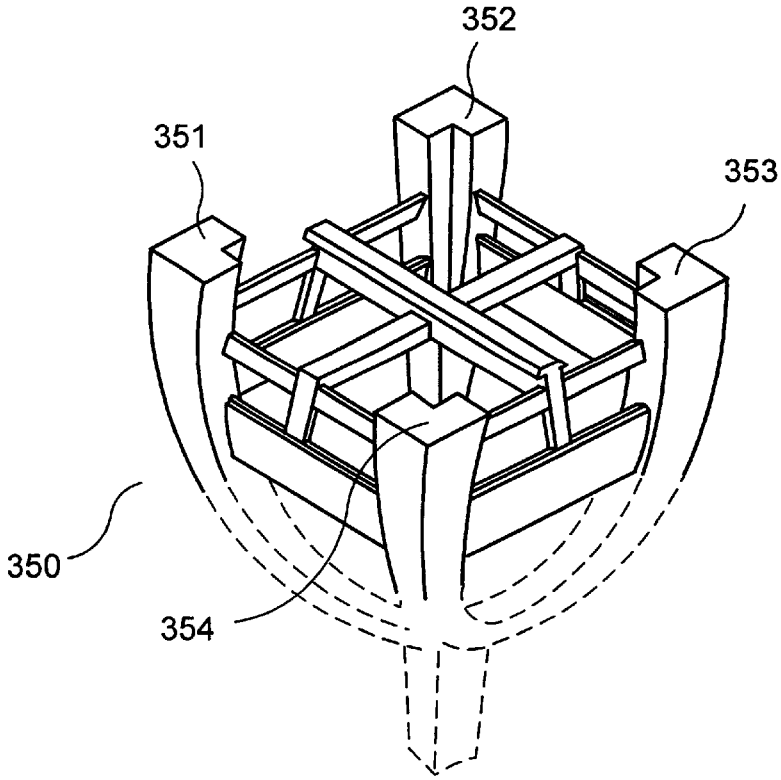
Figure 25B:
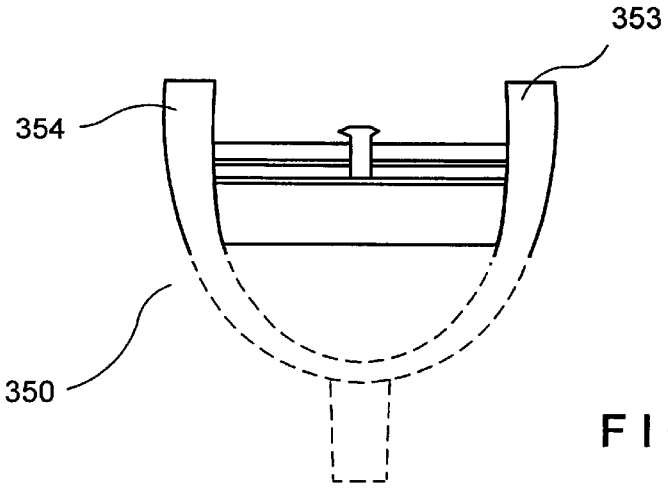
FIG. 25B shows a side view of the seventh embodiment of the jewelry setting illustrated in FIG. 25A with the gemstones removed.
Figure 25C:
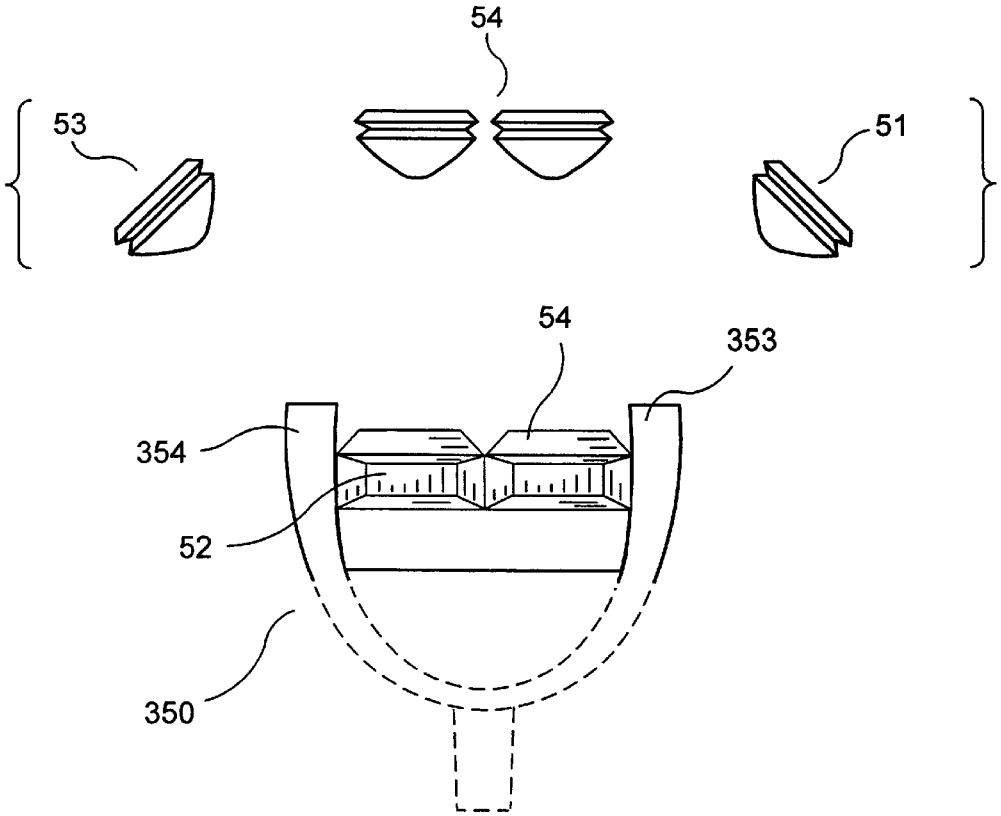
FIG. 25C shows a side view of the seventh embodiment of the jewelry setting illustrated in FIG. 25A with the gemstones provided on the jewelry setting.

FIGS. 25A through 33 illustrate seventh through ninth embodiments of the jewelry setting of the present invention which have L-shaped or V-shaped corner prongs 351–354. FIG. 25A shows a perspective view and FIGS. 25B and 25C (e.g., one with the gemstones in the jewelry setting, and one without the gemstones in the setting) show side views of a first variation of the seventh embodiment of the jewelry setting 350 with the L-shaped or V-shaped corner prongs 351–354. This variation of the seventh embodiment is similar to the first variation of the first embodiment of the jewelry setting shown in FIGS. 1A and 1B, except that the V-shaped or L-shaped corner prongs 351–354 (as opposed to round-shaped prongs) abut and retain corner and/or side gemstones of the sets of gemstones 50–54 in the jewelry setting 350.

Figure 26A:
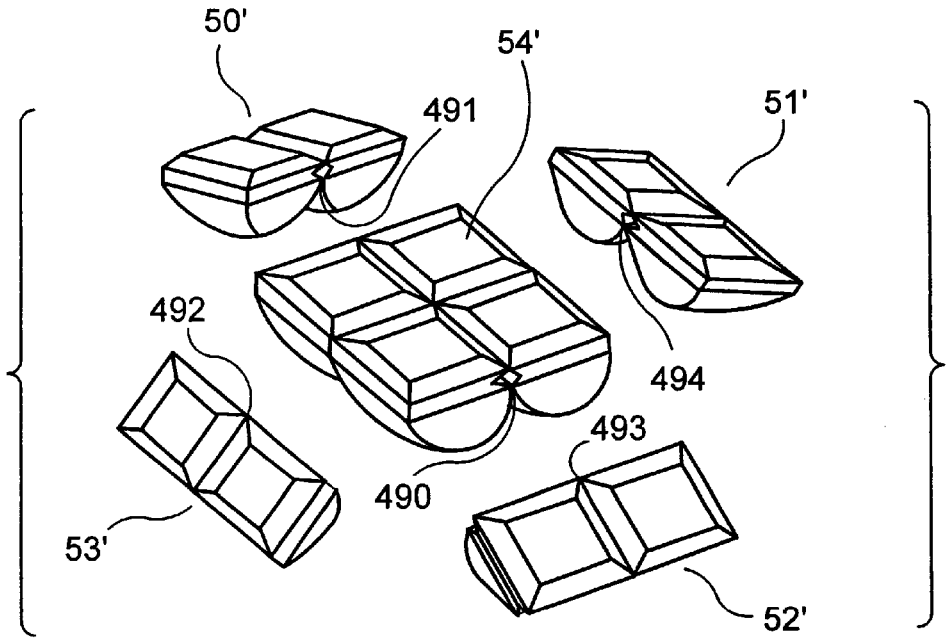
FIG. 26A shows a perspective view of a second variation of the seventh embodiment of the jewelry setting according to the present invention.
Figure 26A:
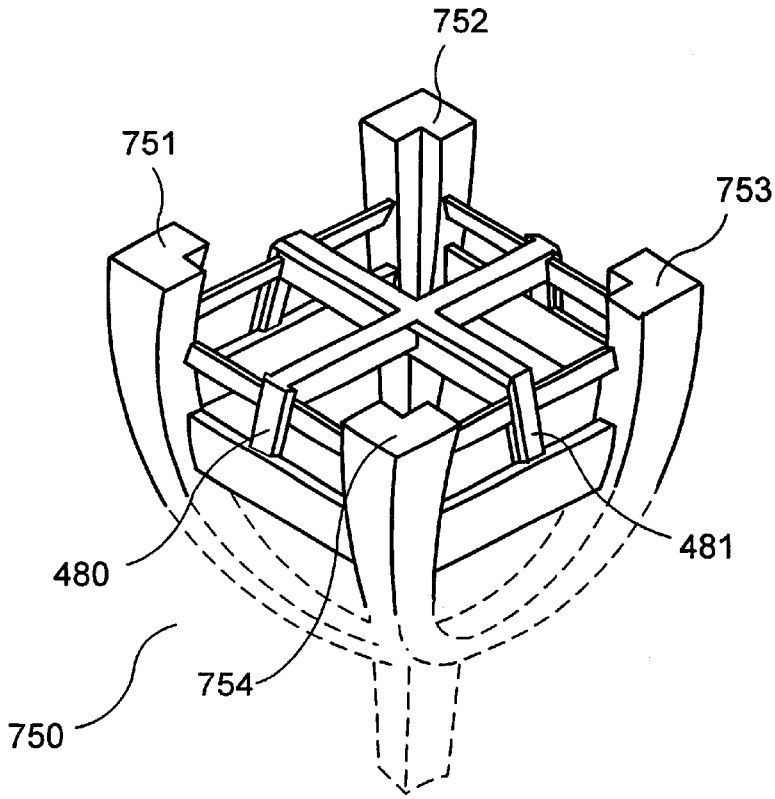
Figure 26B:
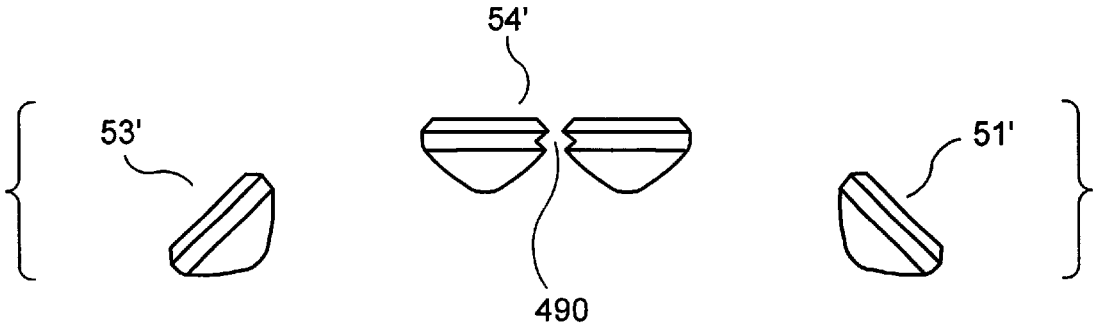
FIG. 26B shows a side view of the seventh embodiment of the jewelry setting illustrated in FIG. 26A with the gemstones removed.
Figure 26B:
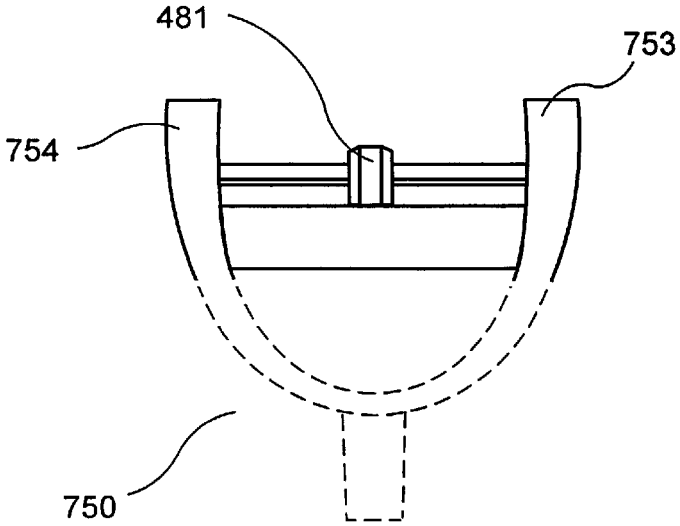

FIGS. 26A and 26B show perspective and side views of a second variation of the seventh embodiment of the jewelry setting 750 with the L-shaped or V-shaped corner prongs 751–754. This variation of the seventh embodiment is similar to the second variation of the first embodiment of the jewelry setting shown in FIGS. 2A and 2B, except that the V-shaped or L-shaped corner prongs 751–754 (as opposed to round-shaped prongs) abut and retain corner and/or side gemstones of the sets of gemstones 50'–54' in the jewelry setting 750.

Figure 27:
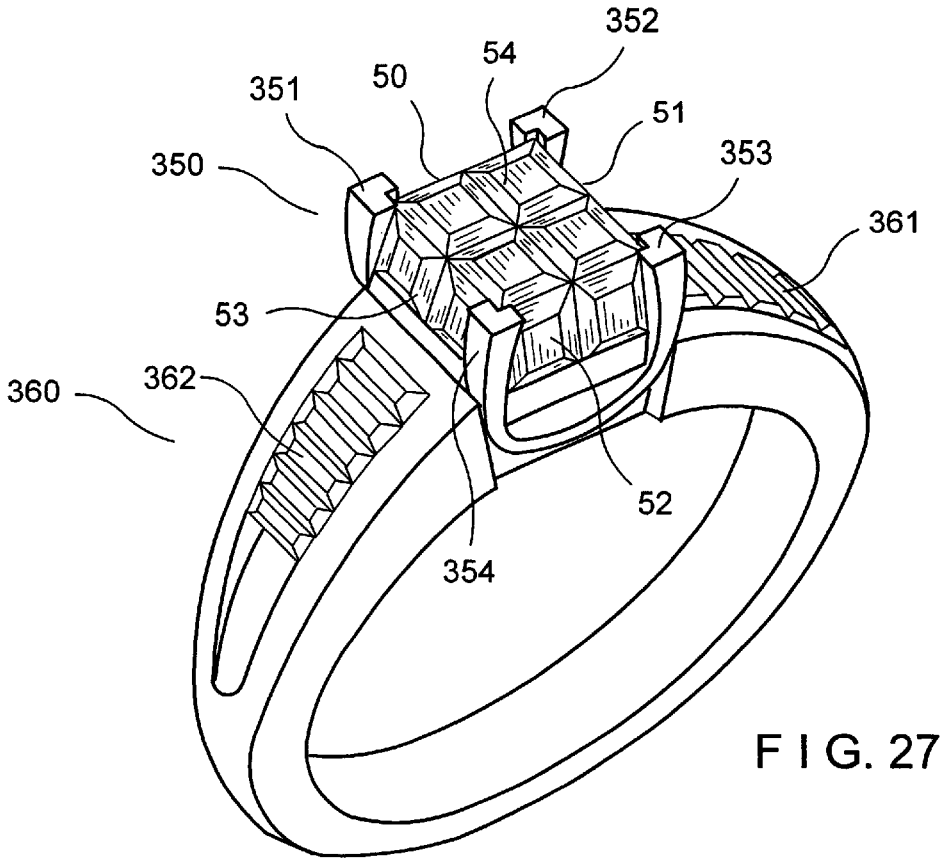
FIG. 27 shows a perspective view of the seventh embodiment of the jewelry setting mounted in a ring.
Figure 28:
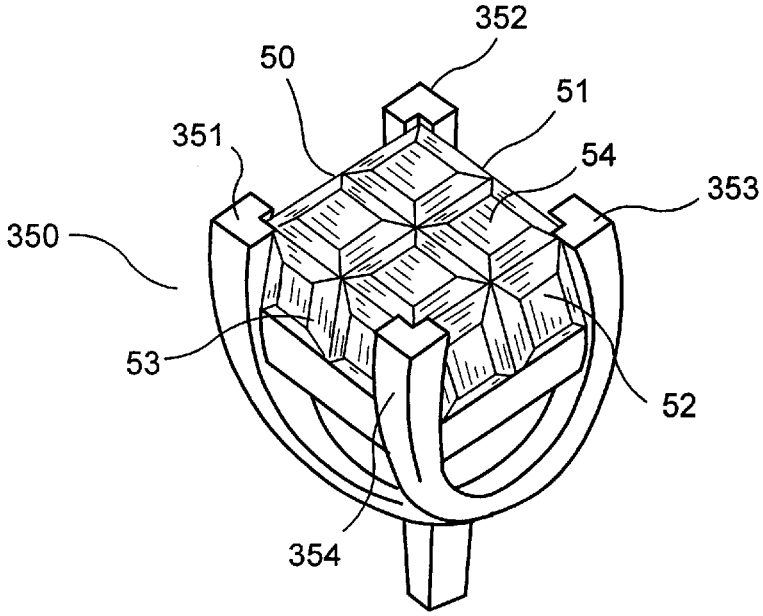
FIG. 28 shows another perspective view of the seventh embodiment of the jewelry setting.

FIG. 27 shows the seventh embodiment of the jewelry setting 350 mounted in a ring 360. Matching rectangular gemstones 361, 362 on a surface of the ring 350 are also provided therein. FIG. 28 shows the seventh embodiment of the jewelry setting 350 on which the gemstones are mounted, and which has L-shaped or V-shaped corner prongs 351–354 that are extent and are joined underneath of the jewelry setting 350 to form a single central post.

Figure 29A:
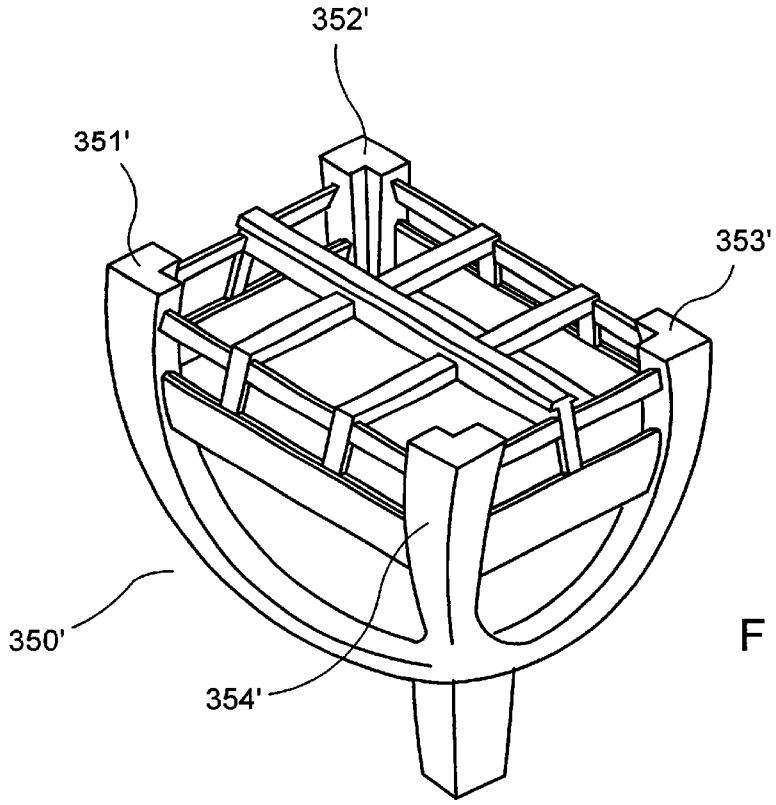
FIG. 29A shows a perspective view of a first variation of an eighth embodiment of the jewelry setting which facilitates six gemstones in the top portion thereof, with the diamonds removed.
Figure 30:
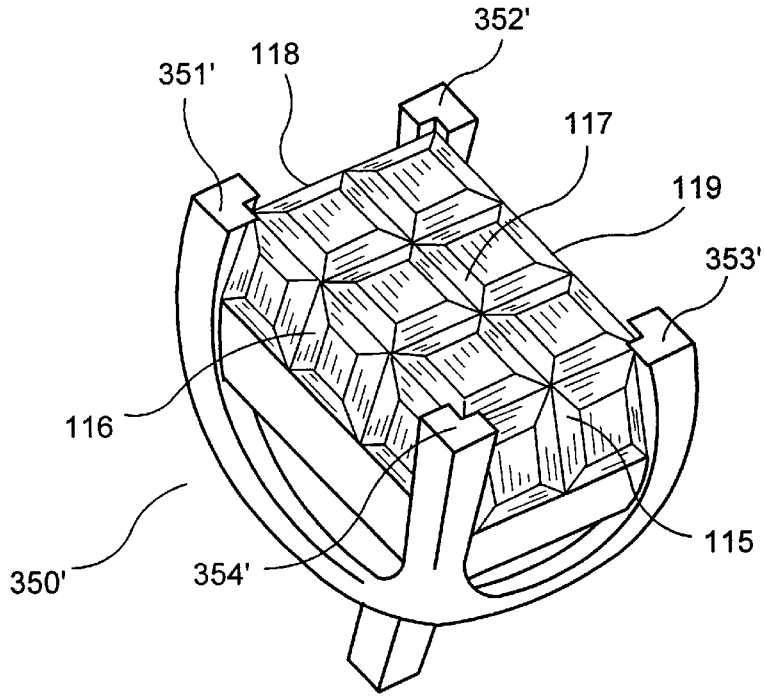
FIG. 30 shows a perspective view of the eighth embodiment of the jewelry setting with the gemstones being facilitated on the top and side portions thereof.
Figure 29B:
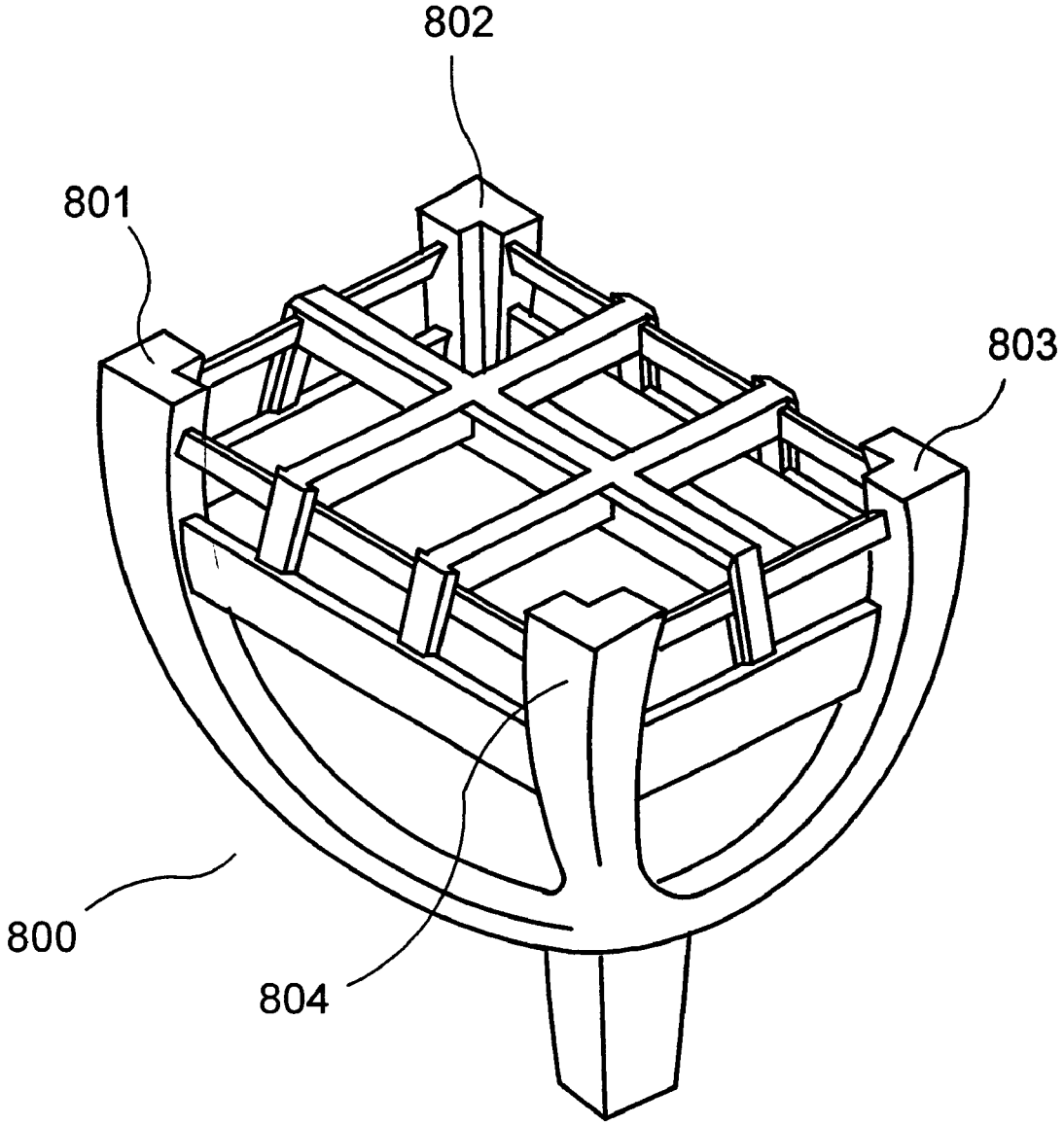
FIG. 29B shows a perspective view of a second variation of the eighth embodiment of the jewelry setting according to the present invention.

FIG. 29A shows a perspective view of a first variation of an eighth embodiment of the jewelry setting 350' with L-shaped or V-shaped corner prongs 351'–354'. This variation of the eighth embodiment of the jewelry setting 350 has the gemstones 116–119 mounted therein, includes the L-shaped or V-shaped corner prongs 351'–354' which extend on a central post (as illustrated in FIG. 30). FIG. 29B shows a perspective view of a second variation of the eight embodiment of the jewelry setting 800 with the L-shaped or V-shaped corner prongs 801–804. This variation of the eighth embodiment is similar to the second variation of the first embodiment of the jewelry setting shown in FIG. 5B, except that the V-shaped or L-shaped corner prongs 801–804 (as opposed to round-shaped prongs) abut and retain corner and/or side gemstones of the sets of gemstones in the jewelry setting 800.

Figure 31:
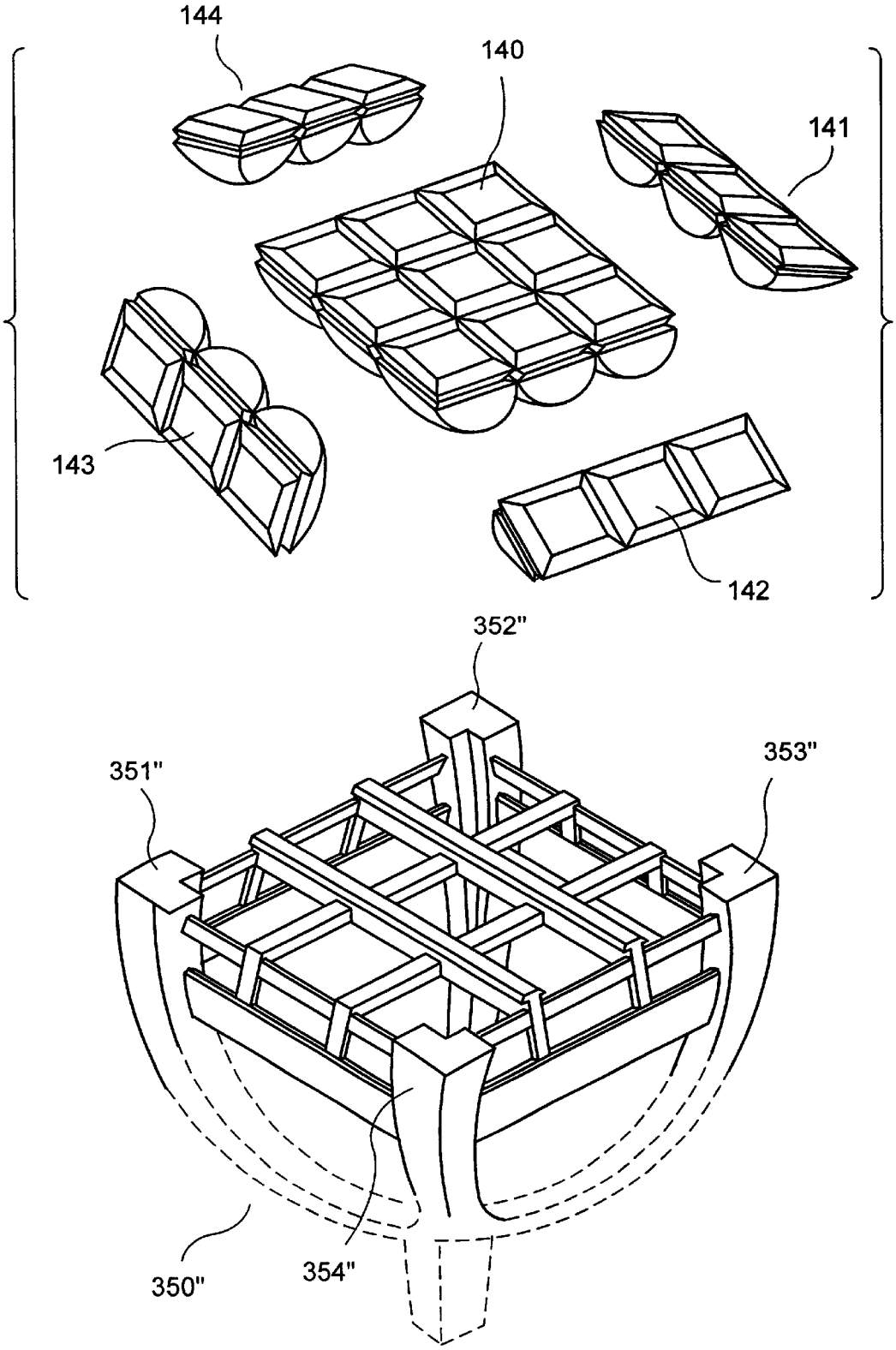
FIG. 31 shows a perspective view of the ninth embodiment of the jewelry setting that is similar to the seventh embodiment which facilitates nine gemstones on the top portion thereof.
Figure 32:
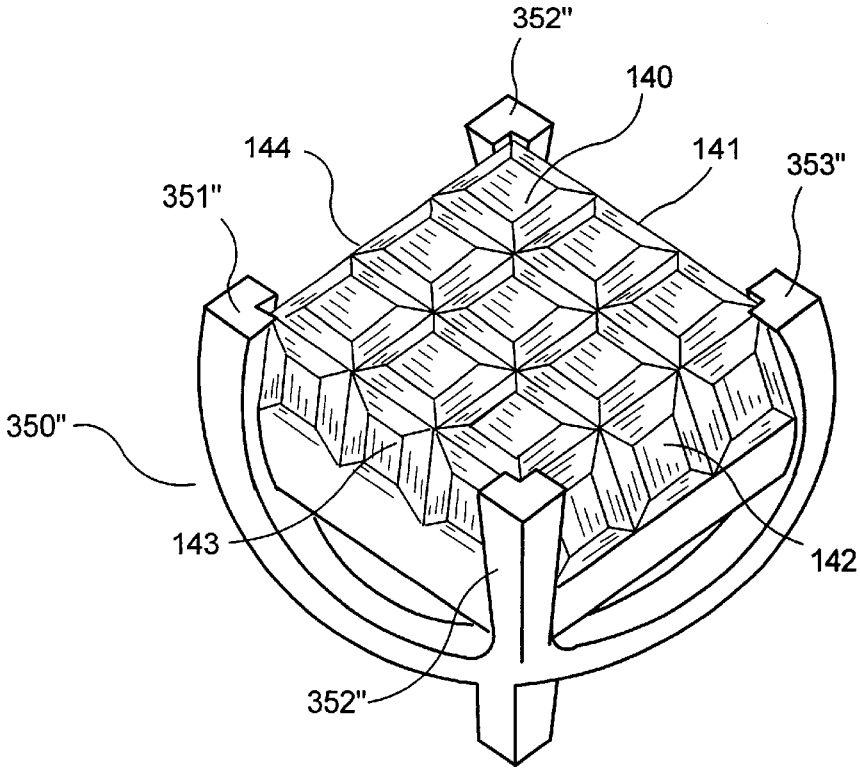
FIG. 32 shows a perspective view of the ninth embodiment of the jewelry setting, with the gemstones being mounted therein.
Figure 33:
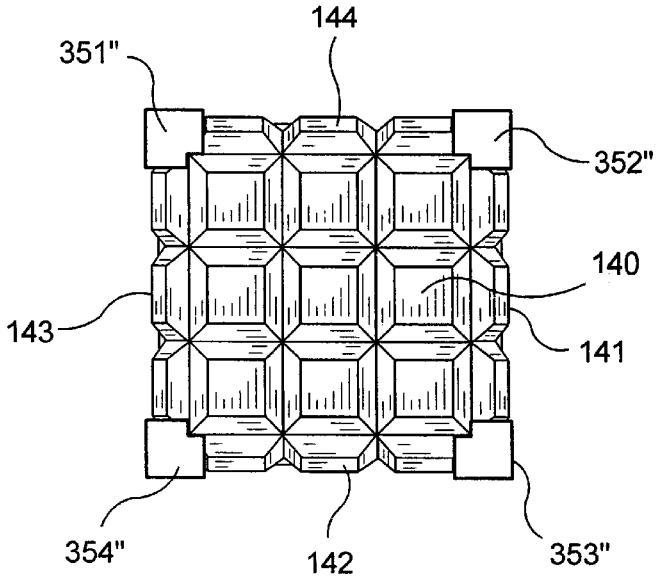
FIG. 33 shows a top view of the ninth embodiment of the jewelry setting illustrated in FIG. 32.

A ninth embodiment of the jewelry setting 350", which has the L-shaped or V-shaped corner prongs 351"–354" and is mounted on a central post, is illustrated in a perspective view in FIG. 31. Other configuration that are similar to the second variation of the third embodiment of the jewelry setting shown in FIGS. 8A and 8B can also be utilized with the ninth embodiment of the jewelry setting. FIGS. 32 and 33 show perspective and top views, respectively, of the ninth embodiment of the jewelry setting shown in FIG. 31, with the gemstones 140–144 mounted therein. The top set of nine gemstones 140, and four side sets of three gemstones 141–144, are illustrated in FIGS. 31–33.

When the gemstones are seated in the jewelry setting, an opening is formed between the edges of the outer gemstones of the center gemstones and the outer gemstones of the side gemstones. This opening is formed because the top portions of the side gemstones extend along a plane which is provided at an acute angle with respect to a plane of extension of the top portions of the center gemstones. The corner prongs can be provided and/or shaped to cover these openings, as well as to aid with the retention of the gemstones in the jewelry setting. According, according to one embodiment of the present invention, it is possible to utilize the corner prongs for minimizing the openings between the gemstones, and to better maintain the gemstones in the setting.

It should be appreciated that those skilled in the art will be able to devise numerous embodiments which, although not explicitly shown or described herein, embody the principles of the invention and are thus within the spirit and scope of the present invention.

What is claimed is:

1. A jewelry setting, comprising:

(a) at least one prong;

(b) a first arrangement including at least one first holding member, the first arrangement being coupled to the at least one prong and extending in a first plane; and (c) at least one second arrangement each including at least one second holding member, the at least one second arrangement being coupled to the at least one prong and to the first arrangement, the at least one second arrangement extending in a second plane, wherein the second plane is provided at a particular angle with respect to the first plane, wherein the particular angle is in a range greater than 0° and as high as 90°, and wherein the at least one second holding member of a particular one of the at least one second arrangement forms at least two gemstone seats therein.

2. The jewelry setting according to claim 1, wherein the at least one prong includes a plurality of prongs.

3. The jewelry setting according to claim 2, wherein the prongs include at least one prong having a substantially round-shaped cross section.

4. The jewelry setting according to claim 2, wherein the prongs include at least one prong having a square-shaped cross section.

5. The jewelry setting according to claim 2, wherein the prongs include at least one prong having one of a V-shaped cross section and an L-shaped cross-section.

6. The jewelry setting according to claim 2, wherein the first arrangement is coupled to particular two prongs of the prongs, and the second arrangement is coupled to the two particular prongs.

7. The jewelry setting according to claim 1, wherein the first arrangement is configured to accept at least one first gemstone, and each of the at least two gemstone seats is configured to accept at least one second gemstone.

8. The jewelry setting according to claim 1, wherein the at least one first holding member is configured to engage at least one groove provided in a sidewall of the at least one first gemstone, and wherein the at least one second holding member is configured to engage at least one groove provided in a sidewall of the at least one second gemstone.

9. The jewelry setting according to claim 1, wherein the first arrangement is configured to accept at least one first gemstone so that a top portion of the at least one gemstone is capable of extending along a third plane which is substantially parallel to the first plane, and wherein each of the at least two gemstone seats is configured to accept at least one second gemstone so that a top portion of the at least one second gemstone is capable of extending along a fourth plane which is substantially parallel to the second plane.

10. The jewelry setting according to claim 1, wherein the at least one first holding member extends along a fifth plane, the fifth plane extending along one of the first plane and a plane which is parallel to the first plane, and wherein the at least one second holding member extends along a sixth plane, the sixth plane extending along one of the second plane and a plane which is parallel to the second plane.

11. The jewelry setting according to claim 1, wherein the at least one second holding member includes at least one track.

12. The jewelry setting according to claim 11, wherein the first arrangement is configured to accept the at least one first gemstone, and each of the at least two gemstone seats is configured to accept at least one of the second gemstones.

13. The jewelry setting according to claim 1, wherein the particular angle is an acute angle.

14. The jewelry setting according to claim 1, wherein the second plane lies along a particular axis.

15. A jewelry arrangement, comprising:

(a) at least one prong;

(b) a first arrangement including at least one first holding member, the first arrangement being coupled to the at least one prong and extending in a first plane; and (c) at least one second arrangement each including at least one second holding member, the at least one second arrangement being coupled to the at least one prong and to the first arrangement, the at least one second arrangement extending in a second plane, wherein the second plane is provided at a particular angle with respect to the first plane, wherein the particular angle is between 0° and 90°, wherein the at least one second holding member of a particular one of the at least one second arrangement forms at least two gemstone seats therein, wherein the at least one prong includes at least four prongs, the at least one first holding member having four side portions, at least two of the four side portions being coupled to each of the four prongs, wherein the at least one second arrangement includes at least four second arrangements, and wherein each of the second holding members of the second arrangements extends from a respective one of the four side portions of the first arrangement to form the at least two gemstone seats.

16. The jewelry arrangement according to claim 15, wherein each of the second holding members extends at the particular angle with respect to the first plane.

17. The jewelry arrangement according to claim 15, wherein the side portions of the at least one first holding member form at least four top holding arrangements, each being provided to facilitate rectangular-shaped gemstones therein, and wherein each of the gemstone seats are provided for facilitating at least one gemstone therein.

18. The jewelry arrangement according to claim 15, wherein the side portions of the at least one first holding member form at least six top first holding arrangements, each being provided to facilitate a rectangular-shaped gemstone therein, wherein a first set of the gemstone seats is provided to facilitate at least two rectangular-shaped gemstones therein, and wherein a second set of the gemstone seats is provided to facilitate at least three rectangular-shaped gemstones therein.

19. The jewelry arrangement according to claim 15, wherein the side portions of the at least one first holding member facilitate at least six top rectangular-shaped gemstones therein, and wherein the gemstone seats include three seats, each facilitating a respective one of three rectangular-shaped gemstones therein.

20. The jewelry arrangement according to claim 15, wherein each of the gemstone seats has a first end and a second end, and wherein each of the at least one first holding member has an end portion which is coupled to a particular point on the respective one of the at least one second arrangement, the particular point being provided between ⅓ and ½ of the distance extending from the first end to the second end.

21. A jewelry arrangement, comprising:

(a) at least one first gemstone;

(b) a plurality of second gemstones;

(c) at least one prong;

(d) a first arrangement including at least one first holding member and configured to accept the at least one first gemstone, the first arrangement being coupled to the at least one prong and extending in a first plane; and (e) at least one second arrangement each including at least one second holding member, the at least one second arrangement being coupled to the at least one prong and to the first arrangement, the at least one second arrangement extending in a second plane, wherein the second plane is provided at a particular angle with respect to the first plane, wherein the particular angle is in a range greater than 0° and as high as 90°, wherein the at least one second holding member of a particular one of the at least one second arrangement forms at least two gemstone seats therein, and wherein each of the at least two gemstone seats is configured to accept at least one of the second gemstones.

* * * * *